US006994523B2

(12) United States Patent
Eguchi et al.

(10) Patent No.: US 6,994,523 B2
(45) Date of Patent: Feb. 7, 2006

(54) AIR BLOWER APPARATUS HAVING BLADES WITH OUTER PERIPHERAL BENDS

(75) Inventors: Akihiro Eguchi, Osaka (JP); Seiji Sato, Osaka (JP)

(73) Assignee: Daikin Industries Ltd., Osaka (JP)

( * ) Notice: Subject to any disclaimer, the term of this patent is extended or adjusted under 35 U.S.C. 154(b) by 44 days.

(21) Appl. No.: 10/475,994

(22) PCT Filed: Feb. 19, 2003

(86) PCT No.: PCT/JP03/01825

§ 371 (c)(1),
(2), (4) Date: Oct. 27, 2003

(87) PCT Pub. No.: WO03/072948

PCT Pub. Date: Sep. 4, 2003

(65) Prior Publication Data

US 2004/0136830 A1 Jul. 15, 2004

(30) Foreign Application Priority Data

Feb. 28, 2002 (JP) ..... 2002-054921

(51) Int. Cl.
*F03B 3/12* (2006.01)

(52) U.S. Cl. ..... 416/228; 416/235; 416/DIG. 2

(58) Field of Classification Search ..... 416/228, 416/234, 235, 236 R, 237, 238, 223 R, DIG. 2
See application file for complete search history.

(56) References Cited

U.S. PATENT DOCUMENTS 1,779,050 A * 10/1930 Schroder ..... 416/163
4,664,593 A * 5/1987 Hayashi et al. ..... 415/119
4,930,990 A * 6/1990 Brackett ..... 416/223 R
5,215,441 A * 6/1993 Evans et al. ..... 416/223 R
5,601,410 A 2/1997 Quinlan
5,616,004 A 4/1997 Alizadeh
6,814,545 B2 * 11/2004 Hext et al. ..... 416/210 R

FOREIGN PATENT DOCUMENTS

| | | |
|---|---|---|
| EP | 0 980 979 A1 | 2/2000 |
| EP | 1 070 849 A2 | 1/2001 |
| GB | 946794 A | 1/1964 |
| GB | 2 050 530 A | 1/1981 |
| JP | 8-121391 A | 5/1996 |
| JP | 08-121391 A | 5/1996 |
| JP | 2000-18194 A | 1/2001 |

* cited by examiner

*Primary Examiner*—Edward K. Look
*Assistant Examiner*—Devin Hanan
(74) *Attorney, Agent, or Firm*—Birch, Stewart, Kolasch & Birch, LLP

(57) ABSTRACT

An air blower apparatus is provided including a hub which is a center of rotation, and a plurality of blades disposed along an outer peripheral surface of the hub and having leading and trailing edges and where both an outer peripheral end of the leading edge and an outer peripheral end of the trailing edge lie ahead relative to the rotative direction. An outer peripheral part of the blade may be bent toward the suction side in such a way as to form a starting point at which an airflow starts leaking, and the radial-direction width, W, of the bent part gradually increases from the vicinity of the leading edge to the vicinity of the trailing edge. A blade tip vortex (β) generated from a blade positioned ahead relative to the rotational direction F and a separation vortex from a pressure surface of a blade positioned behind relative to the rotational direction F offset each other, so that discharge vortexes are suppressed.

12 Claims, 23 Drawing Sheets

AIR BLOWER APPARATUS HAVING BLADES WITH OUTER PERIPHERAL BENDS

This application is the national phase under 35 U.S.C. §371 of PCT International Application No. PCT/JP03/01825 which has an International filing date of Feb. 19, 2003, which designated the United States of America.

TECHNICAL FIELD

The present invention relates to the structure of an air blower apparatus such as a propeller fan and the like.

BACKGROUND ART

Axial blower apparatus, such as propeller fans and the like, generally find application as air blower apparatus for use in air conditioning apparatus outdoor units. Referring to FIGS. 16–18, there is shown a structure of an air conditioning apparatus outdoor unit which employs such an air blower apparatus.

As shown in each of the figures, the aforementioned air conditioning apparatus outdoor unit comprises a main body casing (1) in which an air blower apparatus unit (3) is disposed on the air flow downstream side of a heat exchanger (2) on the side of a rear air inlet (10*a*). This air blower apparatus unit (3) is made up of a propeller fan (4) which is an axial blower apparatus, a bell-mouth (5), situated on the side of an outer periphery of the propeller fan (4), by which a suction region (X) on the rear side of the propeller fan (4) and a discharge region (Y) on the front side of the propeller fan (4) are partitioned from each other, and a fan guard (6) situated on the discharge side of the propeller fan (4) (i.e., on the front side of the propeller fan (4)).

The rear air inlet (10*a*) is formed in a rear surface of the main body casing (1), and a side air inlet (10*b*) is formed in a side surface of the main body casing (10). Additionally, the interior space of the main body casing (10) is divided, by a partition plate (7), into two chambers, namely a heat exchange chamber (8) and a machine chamber (9). Disposed in the heat exchange chamber (8) are a heat exchanger (2) which is L-shaped in transverse section and located face to face with both the rear air inlet (10*a*) and the side air inlet (10*b*) and the aforesaid air blower apparatus unit (3) which is located downstream of the heat exchanger (2). On the other hand, disposed in the machine chamber (9) are a compressor (11) and other component parts. A fan motor (12) for rotatably driving the propeller fan (4) is supported fixedly on a fan motor holding bracket (not shown diagrammatically) disposed downstream of the heat exchanger (2).

The propeller fan (4) is, for example as shown in FIG. 19, linkup-fixed to a drive shaft (12*a*) of the fan motor (12), and comprises a hub (14) which becomes a center of rotation of the propeller fan (4) and a plurality of identical blades (13, 13, 13) which are disposed integrally along an outer peripheral surface of the hub (14). The blade (13, 13, 13) is formed into a swept-forward blade superior in air supplying performance, wherein, at leading and trailing edges (13*a*) and (13*b*) of the blade (13, 13, 13), the position of an outer peripheral end (R) of each edge is situated ahead, relative to the direction of rotation F of the propeller fan (4), of the position of a hub side base end (S) (i.e., the inner peripheral end).

Such an outdoor unit construction may produce inconvenience, i.e., high levels of noise during operation because of the noise generated by the propeller fan (4) itself and, in addition, because of the noise generated upon collision of an air flow discharged from the propeller fan (4) against a downstream structural member such as a fan guard (6) et cetera.

With a view to reducing the total noise of an air blower apparatus (e.g., a propeller fan) of the above-described type that is employed as an air blower apparatus for use in air conditioning apparatus outdoor units, various measures and examinations, such as the optimization of the blade-surface shape of propeller fan blade sections and the thickening of blades for superior aero-performance, have so far been made. Unfortunately, these noise-reduction methods alone fail to provide solutions to the following problems.

When the blades (13, 13, 13) of the propeller fan (4) having a blade structure of FIG. 20 start rotating, this produces an air flow (α) on the side of an outer peripheral part (13*c*) of a blade (13). This air flow (α) enters from the side of a pressure surface (13*d*) of high pressure around into the side of a suction surface (13*e*) of low pressure. The air flow (α) forms a blade tip vortex (β) as shown in the figure. Discharge air flow turbulence caused by the blade tip vortex (β) becomes laminated as the air flow moves downstream, and gradually grows and increases (see FIGS. 21 and 22). The discharge air flow finally moves away from the suction surface (13*e*) of the blade (13), and interferes with the pressure surfaces (13*d*, 13*d*) of the adjoining blades (13, 13), with an inner peripheral surface of the bell-mouth (5), and with a structural member disposed downstream of the air blower apparatus such as the fan guard (6) et cetera, thereby increasing the noise to higher levels. Particularly, as shown in FIG. 22, a blade tip vortex (β) at a distance from the suction surface (13*e*) of the blade (13) will undergo greater turbulence when interfering with the adjoining blades (13, 13). As a result, the blade tip vortex (β) is discharged downstream of the air blower apparatus. This increases levels of noise to a further extent.

Such a phenomenon appears significantly, particularly when reducing the chord length of the blade (13, 13, 13) to achieve weight and cost saving of the air blower apparatus, because such reduction reduces the blade cascade effect of the blade (13, 13, 13). More specifically, as shown in FIG. 23, the blade tip vortex (β) tends to leave the suction surface (13*e*) and interferes early with the adjoining blades (13, 13) in comparison with the aforesaid case.

To cope with the above, the inventors of the present invention previously disclosed, as a technique for suppressing blade tip vortexes as discussed above to reduce levels of noise generated by air blower apparatus such as propeller fans, an improved air blower apparatus (Japanese Patent Application No. 2001-388966). As shown in FIGS. 24–26, an outer peripheral part (13*c*) of the blade (13, 13, 13) of the air blower apparatus is provided with a camber part which becomes gradually greater in radial-direction width from the vicinity of a leading edge toward the vicinity of a trailing edge thereof Such arrangement ensures that blade tip vortexes are suppressed without changing the entire shape of the blade (13, 13, 13).

In other words, the above-described air blower apparatus of the previous invention (which is made up of a hub (14) which becomes a center of rotation as shown in the figure and a plurality of blades (13, 13, 13) disposed along an outer peripheral surface of the hub (14) wherein the blade (13, 13, 13) has a leading edge (13*a*) and a trailing edge (13*b*), and outer peripheral ends of these edges are situated ahead relative to the direction of rotation) is characterized in that the blade (13, 13, 13) is formed such that its outer peripheral part (13*c*) is recurved toward the suction side and such a camber part of the outer peripheral part (13*c*) becomes gradually greater in radial-direction width from the vicinity of the leading edge (13*a*) toward the vicinity of the trailing edge (13*b*).

As described above, in the blade (13, 13, 13) of the air blower apparatus (such as a propeller fan et cetera) which is a so-called swept-forward blade in which the outer peripheral end is situated ahead, relative to the direction of rotation, of the inner peripheral end at the leading and trailing edges (13*a*) and (13*b*) of the blade (13, 13, 13), the outer peripheral part (13*c*) is recurved toward the suction side. As a result of such arrangement, on the side of the outer peripheral end (R) of the blade (13, 13, 13), an air flow is allowed to smoothly flow around and enter into the concave circular arc-shaped, suction surface (13*e*) along the convex circular arc-shaped, pressure surface (13*d*), as shown in FIG. 24. Therefore, the diameter of the blade tip vortex (β) becomes smaller and stable, and an air flow flowing in the direction of the blade outer periphery on the side of the suction surface (13*e*) will no longer interfere with the blade tip vortex (β).

If the width, W, of the camber part of the blade outer peripheral part (13*c*) gradually increases from the vicinity of the leading edge (13*a*) to the vicinity of the trailing edge (13*b*) as described above, the above-described action achieves its effect smoothly from the leading edge's (13*a*) side to the trailing edge's (13*b*) side according to the diameter of the blade tip vortex (β) whose diameter increases when gradually laminated to become larger from the leading edge's (13*a*) side to the trailing edge's (13*b*) side of the blade (13, 13, 13) (see FIG. 25). In addition, the generated blade tip vortex (β) is unlikely to depart from the blade suction surface (13*e*).

Consequently, even when the chord length of the blade (13, 13, 13) is shortened for the purpose of weight saving as shown in FIG. 26, blade tip vortexes (β) will not interfere mutually between the adjoining blades (13, 13, 13), and they are discharged downstream of the air blower apparatus. As a result, the level of noise generated from the air blower apparatus itself is effectively reduced.

Problems to be Solved

It is true that the above-mentioned previous application provides an improved construction capable of achieving blade tip vortex reduction, and of preventing blade tip vortex interference between adjoining blades.

However, for the case of the previous application construction, it has become clear that there is still room for improvement with respect to the point that a generated blade tip vortex grows, and is discharged downstream of the air blower apparatus.

Since such an air blower apparatus is generally employed as an air blower apparatus for use in air conditioning apparatus outdoor units as described above, it is natural that there is a grilled structural member such as a fan guard at a position immediately downstream of the air blower apparatus. Accordingly, when incorporated within the air conditioning apparatus outdoor unit, discharge vortexes from between adjoining blades will interfere with the grilled structural member, thereby generating noise.

In order to provide solutions to these problems, the present invention was made. Accordingly, an object of the present invention is to provide an air blower apparatus capable of achieving blade tip vortex reduction without making any change in the entire blade shape, capable of suppressing the discharging of vortexes to the air blower apparatus downstream side without fail, and capable of effective reduction in noise levels even when incorporated within an air conditioning apparatus outdoor unit, by employing such an arrangement that a blade outer peripheral part of the air blower apparatus is provided with a bent part which becomes gradually greater in radial-direction width from the vicinity of a leading edge toward the vicinity of a trailing edge so that it becomes a starting point at which an air flow from the side of a pressure surface to the side of a suction surface starts leaking.

DISCLOSURE OF INVENTION

In order to achieve the aforementioned object, the present invention provides the following problem solving means.

First Problem Solving Means

The first problem solving means is directed to an air blower apparatus. The air blower apparatus of the first problem solving means comprises a hub (14) which becomes a center of rotation and a plurality of blades (13, 13, 13) disposed along an outer peripheral surface of the hub (14), wherein outer peripheral ends of leading and trailing edges (13*a*) and (13*b*) of each blade (13, 13, 13) are situated ahead relative to the direction of rotation. The air blower apparatus of the first problem solving means is characterized in that an outer peripheral part (13*c*) of each blade (13, 13, 13) is bent toward the suction side so as to define a starting point at which an air flow starts leaking, and that the radial-direction width, W, of the bent part gradually increases from the vicinity of the leading edge (13*a*) to the vicinity of the trailing edge (13*b*).

As described above, the outer peripheral part (13*c*) of each blade (13, 13, 13) is bent toward the suction side so as to define a starting point at which an air flow flowing from the side of a pressure surface toward the side of a suction surface starts leaking, and, in addition, the radial-direction width W of the bent part increases from the vicinity of the leading edge (13*a*) to the vicinity of the trailing edge (13*b*). As a result of such arrangement, an air flow on the side of the pressure surface (13*d*) of the blade (13, 13, 13) is allowed to smoothly enter around into the tapering suction surface (13*e*) along the tapering pressure surface (13*d*) on the side of the blade outer peripheral part, in the same way as the case of the forgoing camber part. Therefore, a blade tip vortex (β), developed by an air flow entering around into the side of the suction surface (13*e*) from the side of the pressure surface (13*d*) of the blade (13, 13, 13), becomes small in diameter and stable, thereby preventing an air flow (γ) flowing in the blade outer peripheral direction on the side of the suction surface (13*e*) from interfering with the blade tip vortex (β).

If the width W of the bent part of the blade outer peripheral part (13*c*) gradually increases from the vicinity of the leading edge (13*a*) to the vicinity of the trailing edge (13*b*) of the blade (13, 13, 13) as described above, the above-described action smoothly achieves its effects from the side of the leading edge (13*a*) up to the side of the trailing edge (13*b*) according to the diameter of the blade tip vortex (β) whose diameter increases when gradually laminated to become larger from the leading edge's (13*a*) side to the trailing edge's (13*b*) side of the blade (13, 13, 13). In addition, the generated blade tip vortex (β) is unlikely to depart from the blade suction surface (13*e*).

Consequently, even when the length of chord is shortened with a view to reducing the weight of the blade (13, 13, 13), blade tip vortexes (β) will not interfere with each other between adjoining blades (13, 13).

On the other hand, unlike the case of the camber part of the previous application, in the above-described arrangement an edge part of the blade outer peripheral part (13*c*) is bent toward the suction side at a given position Q as a starting point relative to the radial direction. This determines a leakage starting point Q of the air flow (α) from the side of the pressure surface (13*d*) to the side of the suction surface (13*e*), and the amount of air flow leakage after the starting point Q becomes constant, thereby making the blade tip vortex (β) stable.

Additionally, at the same time, separation, which has occurred after the starting point Q, generates longitudinal vortexes (δ) on the side of the pressure surface (13*d*) of the blade outer peripheral part (13*c*). A longitudinal vortex (δ) generated in a certain blade (13), and a blade tip vortex (β) generated in one of the remaining blades (13, 13) that is situated next to and ahead of the certain blade (13) relative to the direction of rotation of the air blower apparatus (4) depart from the respective blade surfaces in the vicinity of the trailing edges (13*b*) of the blades (13, 13), and cancel each other. Since these generated vortexes (δ) and (β) cancel each other, this effectively eliminates the discharging of vortexes in the downstream direction (which is the problem with the previous application).

Accordingly, the discharging of vortexes to the downstream side from the impeller of the air blower apparatus (4) is effectively eliminated. This effectively brings about reduction in levels of noise generated by interference of a fan guard et cetera with discharge vortexes from the air blower apparatus (4) when incorporated within the air conditioning apparatus outdoor unit.

Second Problem Solving Means

The air blower apparatus (4) of the second problem solving means according to the first problem solving means is characterized in that the radial-direction width, W, of the bent part is not more than 25% of a length La from a hub-side base end to a radial-direction outer peripheral end (R) of the blade (13, 13, 13).

If the radial-direction width W of the bent part is not more than 25% of the length La from the hub-side base end (S) to the outer peripheral end (R) of the blade (13, 13, 13) at a maximum width portion in the vicinity of the trailing edge, this arrangement makes it possible to achieve, in a most effective manner, the effect of suppressing blade tip vortexes and downstream discharge vortexes as described above within the range in which the air supplying performance of the air blower apparatus (4) does not fall off Stated another way, although the bent part is effective for the suppressing of blade tip vortexes (β) and discharge vortexes, it does not contribute to the performance of supplying air. Accordingly, there is no point in increasing the width W of the bent part more than necessary. Preferably, at least at the maximum width portion in the vicinity of the trailing edge (13*b*), the width W of the bent part varies within a variation span of not more than 25% of the length La from the hub-side base end (S) to the outer peripheral end (R) of the blade (13, 13, 13), according to the front-to-rear length of the blade outer peripheral end (R) (i.e., $0 \leqq W \leqq 0.25$ La). In other words, preferably the width W of the bent part is, even at the maximum width portion in the vicinity of the trailing edge (13*b*), not more than 25% of the length La from the hub-side bade end (S) to the outer peripheral end (R) of the blade (13, 13, 13), and varies within a variation span of $0 \leqq W \leqq 0.25$ La in the front-to-rear direction of the blade outer peripheral end (R).

Third Problem Solving Means

The air blower apparatus (4) of the third problem solving means according to either the first problem solving means or the second problem solving means is characterized as follows. In a chord line C in a given blade radial r, the length of the chord line C is Lo, a given point on the chord line C is P, and the length from the blade leading edge (13*a*) to the given point P is L, while a radial-direction curved line, which extends from a hub-side base end (S) to an outer peripheral end (R) of the blade (13, 13, 13) and passes through the given point P so that the ratio of the length L and the length Lo (i.e., L/Lo) is constant, is K, and the angle, which is formed by the intersection of (a) a straight line Q-R connecting a point Q at which the outer peripheral part (13*c*) of the blade (13, 13, 13) starts bending toward the suction side and the outer peripheral end (R) of the blade (13, 13, 13) in a curved line K' which is a revolved projection of the curved line K onto a plane including a rotation central axis O and (*b*) a tangent line A–A' at the point Q of the curved line K' closer to the side of an inner periphery of the blade (13, 13, 13) than the point Q, is a bending angle θ. The air blower apparatus (4) of the third problem solving means is characterized in that the bending angle θ is varied gradually from the vicinity of the leading edge (13*a*) to the vicinity of the trailing edge (13*b*) of the outer peripheral end (R) of the blade (13, 13, 13).

The bending angle θ of the bent part in the configuration according to the first or second problem solving means is defined in the way as described above, and varies according to the shape of the vane blade (13, 13, 13) such that it gradually increases or decreases from the vicinity of the leading edge (13*a*) to the vicinity of the trailing edge (13*b*) of the blade outer peripheral end (R) under the foregoing conditions. This arrangement makes it possible to achieve the effect of suppressing both blade tip vortexes (β) and discharge vortexes in the first or second problem solving means as effectively as possible.

In other words, in general, the difference in pressure between the pressure surface (13*d*) and the suction surface (13*e*) increases gradually from the leading edge (13*a*) to the trailing edge (13*b*) of the blade (13, 13, 13), in association with which the strength of "entering-around" (variation in air flow direction) of an air flow from the side of the pressure surface (13*d*) into to the side of the suction surface (13*e*) gradually increases toward the trailing edge.

On the contrary, if the bending angle θ at the outer peripheral part (13*c*) of the blade (13, 13, 13) is increased gradually from the leading edge (13*a*) to the trailing edge (13*b*) (in other words the angle of inclination of the bent part is made steep) so that blade tip vortexes (β) as describe above are developed stably on the side of the suction surface (13*e*) of the bent part formed in the outer peripheral part (13*c*) of the blade (13, 13, 13), this makes it possible to make the scale of the generated blade tip vortexes (β) as small as possible, and the scale of discharge vortexes is also reduced.

On the other hand, contrary to the above, if the bending angle θ is lessened gradually from the side of the leading edge (13*a*) to the side of the trailing edge (13*b*) (in other words the angle of inclination of the bent part is made gentle), this causes the bending angle θ to decrease according to the growth of a blade tip vortex (β) that grows gradually in the direction of the trailing edge (13*b*). This accordingly ensures that a blade tip vortex (β) is held on the side of the suction surface (13*e*) of the bent part formed at the outer peripheral part (13*c*) of the blade (13, 13, 13), thereby effectively suppressing interference of adjoining blades (13, 13) and blade tip vortexes (β).

By gradually varying the bending angle θ at the blade outer peripheral part (13*c*) from the side of the leading edge (13*a*) to the side of the trailing edge (13*b*), it becomes possible to effectively suppress noise due to the blade tip vortex (β) and noise due the discharge vortex when incorporated in air conditioning apparatus.

Fourth Problem Solving Means

The air blower apparatus (4) of the fourth problem solving means according to the third problem solving mean is characterized in that the curved line K' comprises, between the hub-side base end (S) and the outer peripheral end (R), an inner peripheral segment which is in the form of a straight line, a central segment which is convex toward the suction side, and an outer peripheral segment which is bent toward the suction side, and is hook-shaped as a whole.

The blade (13, 13, 13) is formed such that the curved line K' has a shape as described above. More specifically, since the inner peripheral segment comprises a straight line, an air flow toward the blade outer peripheral end (R), generated on the side of the suction surface (13*e*) of the blade (13, 13, 13) by centrifugal force during rotation, moves stably (adhesively) along the suction surface (13*e*) without separating from the suction surface (13*e*). Accordingly, the air flow is unlikely to interfere with a blade tip vortex (β).

Additionally, because of the arrangement that the shape of the central segment is convex toward the suction side, the flow velocity of an air flow which intends to move to the side of the suction surface (13*e*) from the side of the pressure surface (13*d*) is suppressed beforehand on the side of the pressure surface (13*d*). As a result, it becomes possible to reduce the scale of a blade tip vortex (β) itself which is formed by the air flow.

Furthermore, in the present problem solving means, the outer peripheral segment is bent toward the suction side. Because of this, an air flow on the side of the pressure surface (13*d*) of the blade (13, 13, 13) moves along the tapering pressure surface (13*d*) in the blade outer peripheral part (13*c*), and smoothly enters around into the tapering suction surface (13*e*). As a result, the vortex diameter of the blade tip vortex (β) becomes further smaller and stable, whereby an air flow flowing in the blade outer peripheral end (R) on the side of the suction surface (13*e*) is made unlikely to interfere with the blade tip vortex (β).

Fifth Problem Solving Means

The air blower apparatus (4) of the fourth problem solving means according to the third problem solving mean is characterized in that the curved line K' comprises, between the hub-side base end (S) and the outer peripheral end (R), an inner peripheral segment which is concave toward the suction side, a central segment which is convex toward the suction side, and an outer peripheral segment which bent toward the suction side, and is hook-shaped as a whole.

The blade (13, 13, 13) is formed such that the curved line K' has a shape as described above. More specifically, since the inner peripheral segment is concave toward the suction side, an air flow toward the blade outer peripheral end (R), generated on the side of the suction surface (13*e*) of the blade (13, 13, 13) by centrifugal force during rotation, moves stably (adhesively) along the suction surface (13*e*) without separating from the suction surface (13*e*). Accordingly, the air flow is unlikely to interfere with a blade tip vortex (β).

Additionally, because of the arrangement that the shape of the central segment is convex toward the suction side, the flow velocity of an air flow which intends to flow to the side of the suction surface (13*e*) from the side of the pressure surface (13*d*) is suppressed beforehand on the side of the pressure surface (13*d*). As a result, it becomes possible to reduce the scale of a blade tip vortex (β) itself which is formed by the air flow.

Furthermore, in the present problem solving means, the outer peripheral part (13*c*) of the blade (13, 13, 13) is bent toward the suction side. Because of this, an air flow on the side of the pressure surface (13*d*) of the blade (13, 13, 13) flows along the tapering pressure surface (13*d*) in the blade outer peripheral part (13*c*), and smoothly enters around into the tapering suction surface (13*e*). As a result, the vortex diameter of the blade tip vortex (β) becomes further smaller and stable, whereby an air flow flowing in the blade outer peripheral end (R) on the side of the suction surface (13*e*) is made unlikely to interfere with the blade tip vortex (β).

If the width W of the bent part of the blade outer peripheral part (13*c*) gradually increases from the vicinity of the leading edge (13*a*) to the vicinity of the trailing edge (13*b*) of the blade (13, 13, 13) as described above, the above-described action of the blade outer peripheral end part achieves more smoothly its air flow guiding effects from the side of the leading edge (13*a*) up to the side of the trailing edge (13*b*) according to the diameter of the blade tip vortex (β) whose diameter increases when gradually laminated to become larger from the leading edge's (13*a*) side to the trailing edge's (13*b*) side of the blade (13, 13, 13) (see FIG. 25). In addition, the generated blade tip vortex (β) is unlikely to depart from the blade suction surface (13*e*).

Consequently, as described above, even when the length of chord is shortened with a view to reducing the weight of the blade (13, 13, 13), blade tip vortexes (β) generated will not interfere with each other between adjoining blades (13, 13), and discharge vortexes to downstream of the air blower apparatus (4) are reduced.

As the result of these, with the configuration of the present problem solving means, the above-described actions are combined together effectively, thereby bringing about a satisfactory reduction in levels of noise when incorporated in air conditioning apparatus outdoor units.

Sixth Problem Solving Means

The air blower apparatus (4) of the sixth problem solving means according to any one of the third to fifth problem solving means is characterized in that the angle $\theta_2$, formed by the bent part of the blade outer peripheral part (13*c*) on the curved line K' and a plane orthogonal to the rotation central axis O, is not more than 90 degrees.

In the case where the blade (13, 13, 13) whose angle of forward tilting is great as described above is manufactured by molding of synthetic resin, the operation of product releasing (i.e., molding removal) becomes difficult to perform, thereby making the efficiency of molding worse.

However, the above-described arrangement that the angle $\theta_2$, formed by the intersection of the bent part of the blade outer peripheral part (13*c*) on the curved line K' and a plane orthogonal to a rotation central axis O, is not more than 90 degrees, makes it possible to provide an adequate draft angle, thereby facilitating molding work and improving the efficiency of molding.

Seventh Problem Solving Means

The air blower apparatus (4) of the seventh problem solving means according to any one of the first to sixth problem solving means is characterized in that a rounded surface is formed only on the side of the blade pressure surface (13*d*) of the blade outer peripheral end (R).

Such arrangement that a rounded surface is formed only on the side of the blade pressure surface (13*d*) of the blade outer peripheral end (R) prevents the occurrence of air flow turbulence by the edge part, thereby enabling an air flow to more smoothly enter from the side of the pressure surface (13*d*) of the blade outer peripheral part (13*c*) around into the suction surface (13*e*).

Eighth Problem Solving Means

The air blower apparatus (4) of the eighth problem solving means according to the seventh problem solving means is characterized in that the size of the rounded surface formed on the side of the blade pressure surface (13*d*) of the blade outer peripheral end (R) is not less than t nor more than 3 t where t is the thickness of the blade (13, 13, 13) in the vicinity of the outside diameter of an impeller.

Because of the arrangement that the size of the rounded surface formed on the side of the blade pressure surface (13*d*) of the blade outer peripheral end (R) is not less than t nor more than 3 t where the thickness of the blade (13, 13, 13) in the vicinity of the outside diameter of an impeller of the air blower apparatus (4) is t, the action of the seventh problem solving means is more effectively achieved all over the region from the vicinity of the leading edge (13*a*) to the vicinity of the trailing edge (13*b*).

In other words, if, at the outer peripheral end (R) of the blade (13, 13, 13), the curvature radius r' of the rounded surface formed on the side of the pressure surface (13*d*) is made to range from t to 3 t as described above according to the variation in the direction of an air flow at the time when the air flow enters from the side of the pressure surface (13*d*) around into the side of the suction surface (13*e*), the air flow more smoothly enters from the side of the pressure surface (13*d*) around into the side of the suction surface (13*e*). Consequently, blade tip vortexes (β) are suppressed effectively, thereby achieving a reduction in noise levels.

Ninth Problem Solving Means

The air blower apparatus (4) of the ninth problem solving means according to any one of the first to eighth problem solving means is characterized in that the air blower apparatus is so constructed as to be incorporated within an air conditioning apparatus outdoor unit.

As has been described above, each of the first to eighth problem solving means significantly reduces generation of discharge vortexes from the air blower apparatus (4) itself Accordingly, the air blower apparatus (4) of each problem solving means is most suitable for achieving reduction in levels of noise when incorporated within an air conditioning apparatus outdoor unit in which obstacles (e.g., a fan guard) that may interfere with discharge vortexes are disposed downstream of the discharge outlet.

Effects

Accordingly, the air blower apparatus (4) of the present invention provides the following beneficial effects.

(i) Noise generated by the air blower apparatus (4) itself is reduced, and noise when the air blower apparatus (4) is incorporated within an air conditioning apparatus outdoor unit is reduced effectively.

(ii) Even in the case where the length of chord of the blade (13, 13, 13) is shortened for accomplishing reduction in weight and costs of the blade (13, 13, 13), the blade tip vortex (β) will not depart from the suction surface, and will not interfere with the adjoining blade. This provides enhanced noise reduction effects, and suppresses the drop in air supplying performance.

(iii) Molding becomes easy to perform and reduction in manufacturing costs is achieved, which is achieved just by forming a bent part at an outer peripheral end portion which is a part of the blade (13, 13, 13) without affecting the entire shape of the blade (13, 13, 13) which determines the air supplying performance thereof (iv) Additionally, since the bent part achieves a rib action, this increases the rigidity of the blade (13, 13, 13). As a result, the blade (13, 13, 13) can be thinned, thereby making it possible to further reduce the manufacturing costs of the blade (13, 13, 13). At the same time, the resistance to vibration of the blade (13, 13, 13) is improved, thereby reducing the generation of abnormal noise due to vibrations.

(v) In addition to the above-mentioned effects, the drop in air supplying performance is suppressed or prevented.

BEST MODE FOR CARRYING OUT INVENTION

Figure 1:
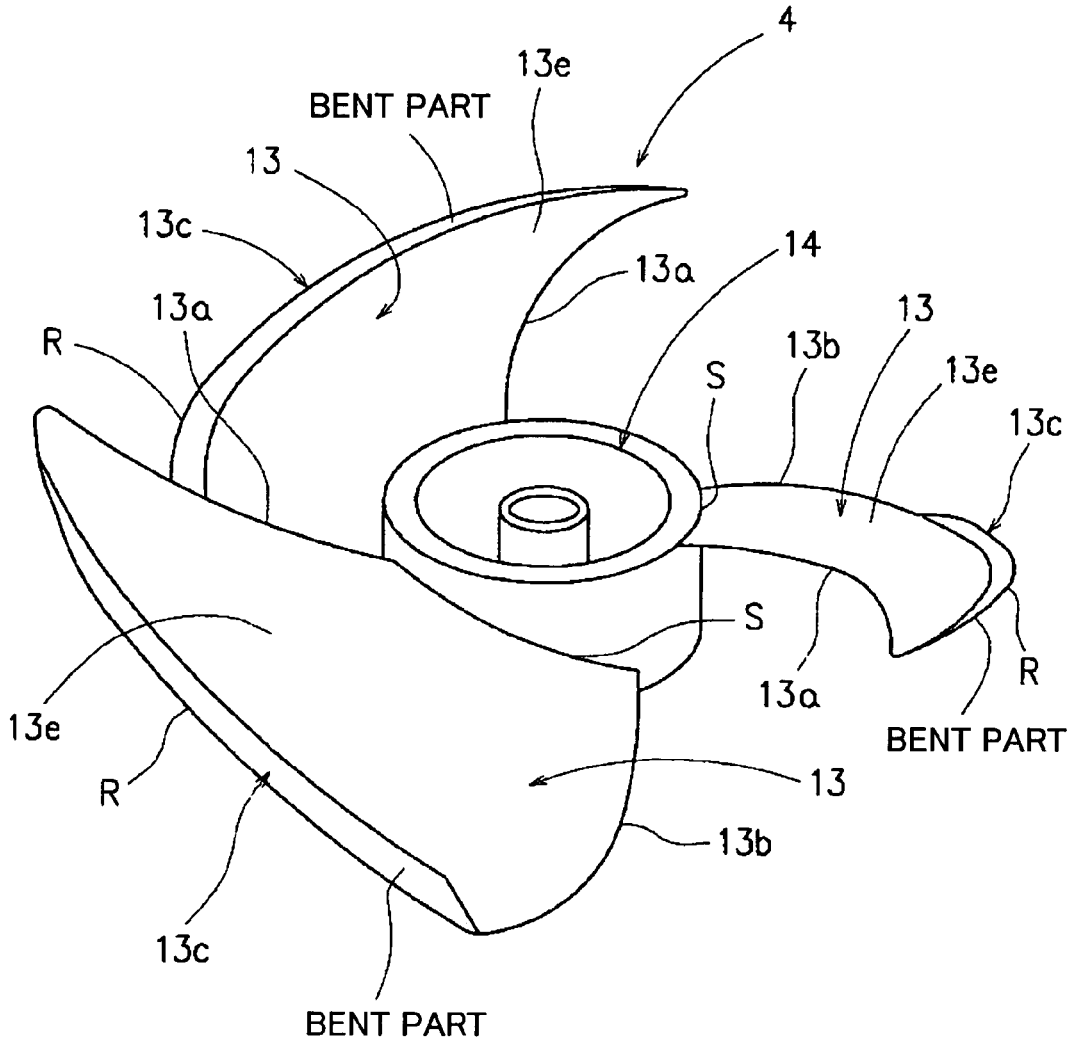
FIG. 1 is a perspective view of an impeller section of an air blower apparatus according to a first embodiment of the present invention.

Hereinafter, embodiments of the present invention will be described in detail with reference to the drawing figures.

First Embodiment

FIGS. 1–15 show structures and actions of an air blower apparatus (4) according to a first embodiment of the present invention. The air blower apparatus (4) is a propeller fan that is suitable for use in air conditioning apparatus outdoor units.

More specifically, FIGS. 1–11 illustrate basic structures and actions of an impeller section of the air blower apparatus (4), and FIGS. 12–15 illustrate shapes of a blade (13) of the impeller section according to several modification examples of the first embodiment.

Basic Structure of Impeller Section

Referring to FIGS. 1–11, the air blower apparatus (4), which is a propeller fan, has a hub (14) of synthetic resin. The hub (14) is a center of rotation of the air blower apparatus (14), and three identical blades (13, 13, 13) are disposed integrally along an outer peripheral surface of the hub (14).

The blade (13, 13, 13) has a leading edge (13*a*) and a trailing edge (13*b*), wherein both an outer peripheral end (R) of the leading edge (13*a*) and an outer peripheral end (R) of the trailing edge (13*b*) are situated ahead, relative to the direction of rotation F of the blade (13, 13, 13), of an inner peripheral end (S) on the side of the hub (14). Additionally, as shown in the figure, an outer peripheral part (13*c*) of the blade (13, 13, 13) is bent toward the suction side at a predetermined width from the vicinity of the leading edge (13*a*) to the vicinity of the trailing edge (13*b*) so that a starting point Q, at which an air flow starts leaking from the side of a pressure surface (13*d*) to the side of a suction surface (13*e*), is defined. The radial-direction width, W, of such a bent part (i.e., the width of a projection surface of the bent edge part to the suction side) is gradually extended at a predetermined ratio from the vicinity of the leading edge (13*a*) to the vicinity of the trailing edge (13*b*) (W=0 at the leading edge (13*a*) and W=Maximum at the trailing edge (13*b*), as shown in FIG. 3).

Preferably, the radial-direction width W of the bent part is not more than 25% of the radial-direction length, La, from the base end of the blade (13, 13, 13) on the side of the hub (14) (i.e., the root of the blade (13, 13, 13)) to the outer peripheral end (R) at the maximum-width portion of the trailing edge (13*b*), for effectively suppressing the forgoing blade tip vortex (β) without causing a drop in air supplying performance of the blade (13, 13, 13).

Stated another way, for example in a blade (hub ratio: 0.3; fan outside diameter: 400 mm), the width W of a maximum-width portion on the side of the trailing edge (13*b*) in the bent part is preferably not more than 35 mm, which is the range in which the drop in air supplying performance does not occur and, in addition, offset vortexes (δ), which will be described later, are generated sufficiently at the pressure surface (13*d*).

Figure 3:
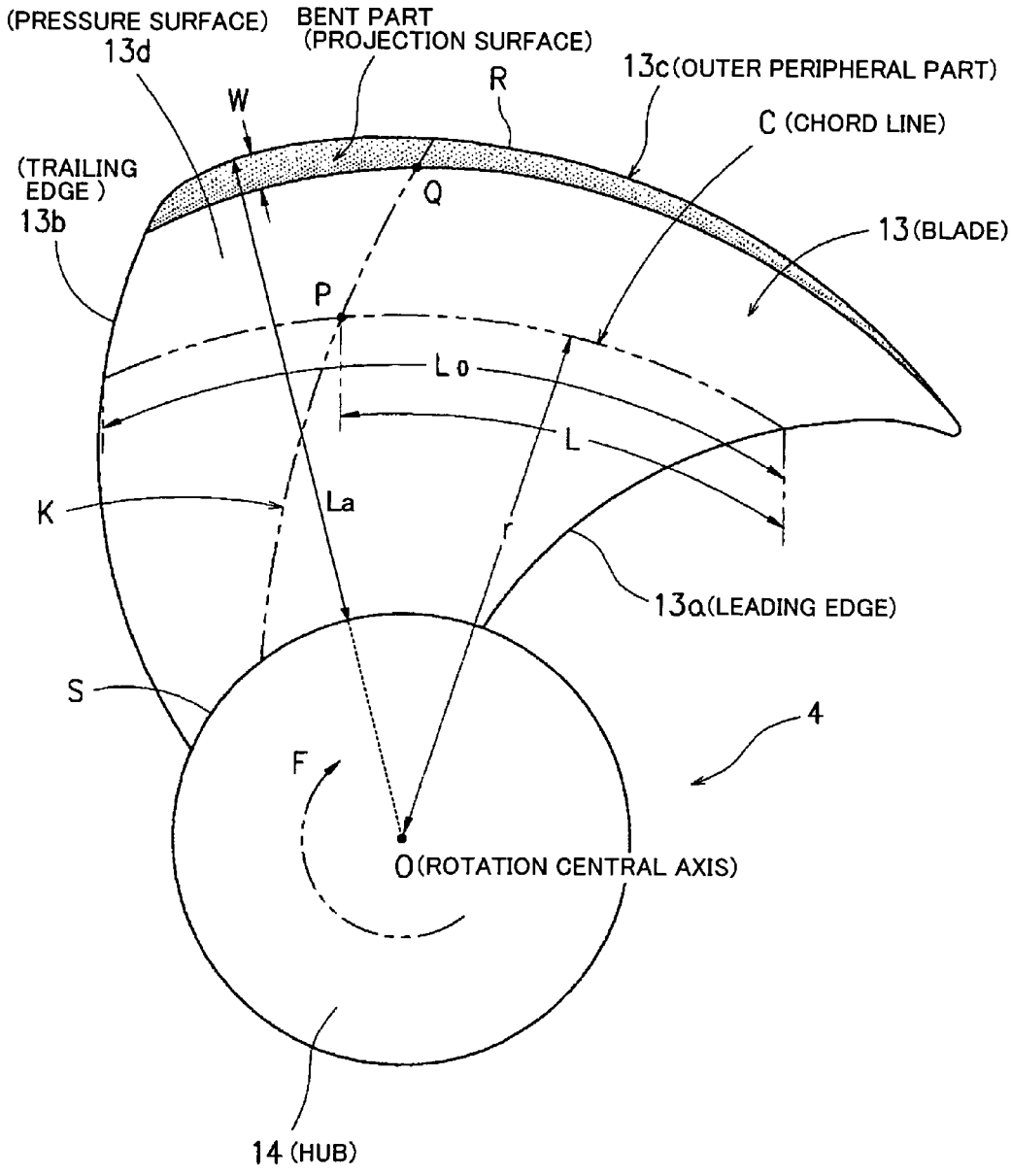
FIG. 3 is a rear view diagram for illustration of a hub and a blade section of the air blower apparatus.
Figure 7:
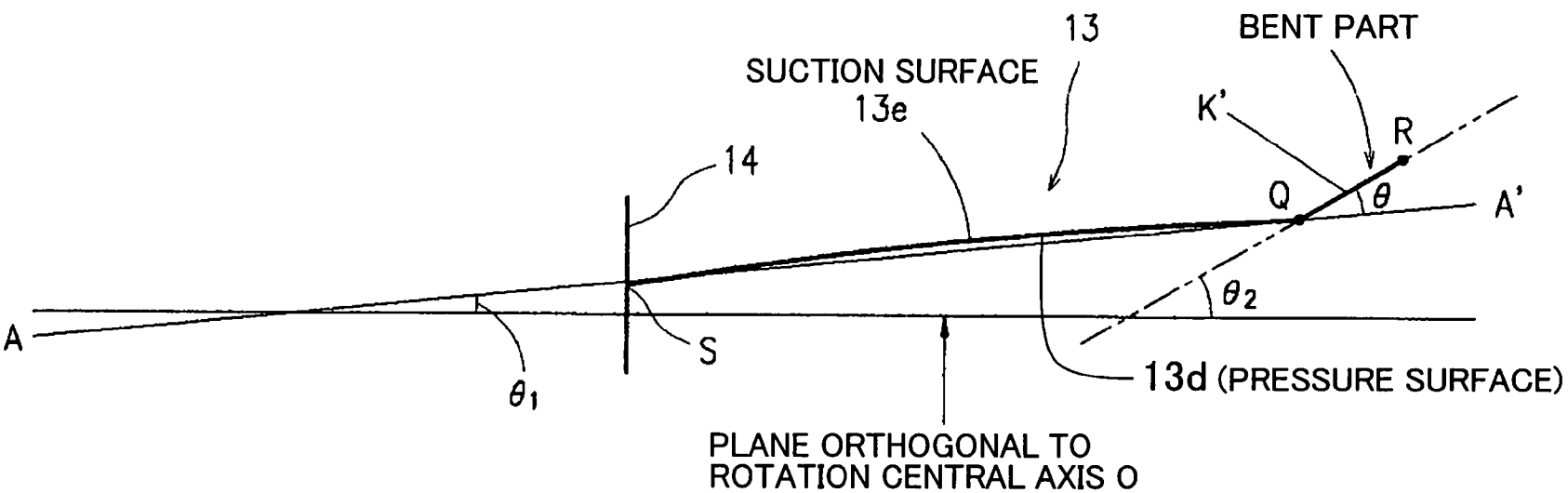
FIG. 7 is an illustrative diagram showing a bending angle, θ, of the air blower apparatus blade.

Here, for example as shown in FIGS. 3 and 7, in a chord line C in a given blade radius R, the length of the chord line C is Lo, a given point on the chord line C is P, and the length from the blade leading edge (13*a*) to the given point P is L. Additionally, a radial-direction curved line, which extends from a hub-side base end (S) to an outer peripheral end (R) of the blade (13, 13, 13) and passes through the given point P so that the ratio of the length L and the length Lo (i.e., L/Lo) is constant, is K, and the angle, which is formed by the intersection of (a) a straight line Q-R connecting a point Q at which the outer peripheral part (13*c*) of the blade (13, 13, 13) starts bending toward the suction side and the outer peripheral end (R) of the blade (13, 13, 13) in a curved line K' which is a revolved projection of the curved line K onto a plane including a rotation central axis O and (b) a tangent line A–A' at the point Q of the curved line K' closer to the side of an inner periphery of the blade (13, 13, 13) than the point Q, is a bending angle θ. In this case, in the blade (13, 13, 13) of the first embodiment, the bending angle θ is varied gradually from the vicinity of the leading edge (13*a*) to the vicinity of the trailing edge (13*b*) of the outer peripheral end (R) of the blade (13, 13, 13).

Furthermore, the angle, formed by (a) the straight line Q-R connecting the point Q on the curved line K' at which the outer peripheral part (13*c*) of the blade (13, 13, 13) starts bending toward the suction side and the outer peripheral end (R) of the blade (13, 13, 13) and (b) a plane orthogonal to the rotation central axis O of the blade (13, 13, 13), is $\theta_2$. In the blade (13, 13, 13) of the first embodiment, i.e., in the swept-forward blade in which the angle of forward tilting of the blade (13, 13, 13) is positive on the side of the leading edge (13*a*) and, on the other hand, is negative on the side of the trailing edge (13*b*), the value of the angle $\theta_2$ is constant (see FIG. 4). Additionally, the value of the angle $\theta_2$ is not more than 90 degrees for easy molding of the blade (13, 13, 13).

Figure 5:
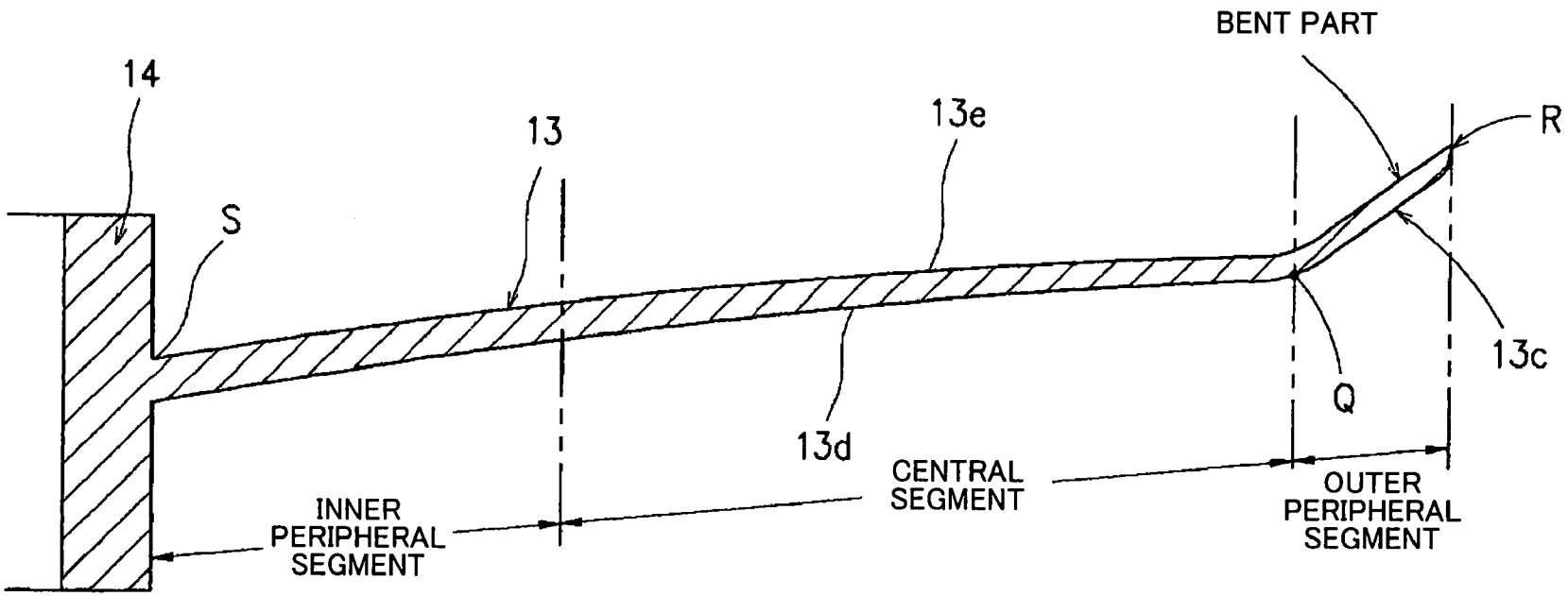
FIG. 5 is a cross-sectional view showing a basic shape of the air blower apparatus blade.

Additionally, for example as shown in detail in FIG. 5, the cross sectional view of the blade (13, 13, 13) by revolved projection of the curved line K upon a plane that passes through the rotation central axis O of the blade (13, 13, 13) comprises, between the hub-side base end (S) and the blade outer peripheral end (R), three regions of different shapes, namely an inner peripheral segment which is concave toward the suction side (or which is approximately in the shape of a straight line), a central segment which is convex toward the suction side, and an outer peripheral end segment which is partially bent toward the suction side.

Figure 6:
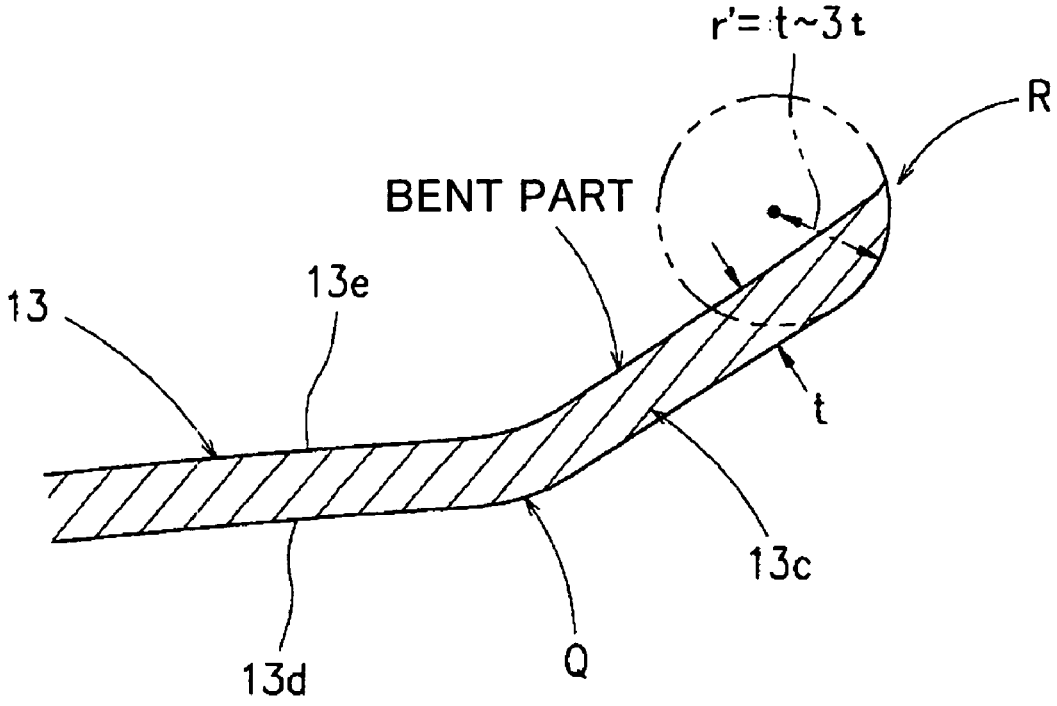
FIG. 6 is an enlarged cross-sectional view showing a shape of a principal part of the air blower apparatus blade.

Furthermore, for example as shown in FIG. 6, in the outer peripheral part (13*c*) of the blade (13, 13, 13), a rounded surface (i.e., a curved surface) is formed only on the side of the pressure surface (13*d*) by cutting an edge part on the side of the pressure surface (13*d*).

The size (curvature radius r') of the rounded surface formed on the side of the pressure surface (13*d*) of the outer peripheral part (13*c*) varies within a range between not less than t and not more than 3 t where t, the reference thickness, is the thickness of the blade (13, 13, 13) in the vicinity of the outer periphery of the impeller of the air blower apparatus (4).

Action of Blade Section

As described above, the air blower apparatus (4) of the first embodiment of the present invention is an air blower apparatus (4), such as a propeller fan et cetera, which comprises a hub (14) which serves as a center of rotation of the air blower apparatus (4) and a plurality of blades (13, 13, 13) disposed along an outer peripheral surface of the hub (14) and each having a leading edge (13*a*) and a trailing edge (13*b*) wherein an outer peripheral end (R) of each of the leading and trailing edges (13*a*) and (13*b*) lies ahead relative to the direction of rotation F. In the air blower apparatus (4), the blade (13, 13, 13) is characterized in that the outer peripheral part (13*c*) thereof is bent toward the suction side into approximately a V-shape so as to form a starting point Q at which an air flow (α) starts leaking. The blade (13, 13, 13) is further characterized in that it is formed such that the radial-direction width W of the bent part gradually increases from the vicinity of the leading edge (13*a*) toward the vicinity of the trailing edge (13*b*) (see FIGS. 1–6).

Figure 9:
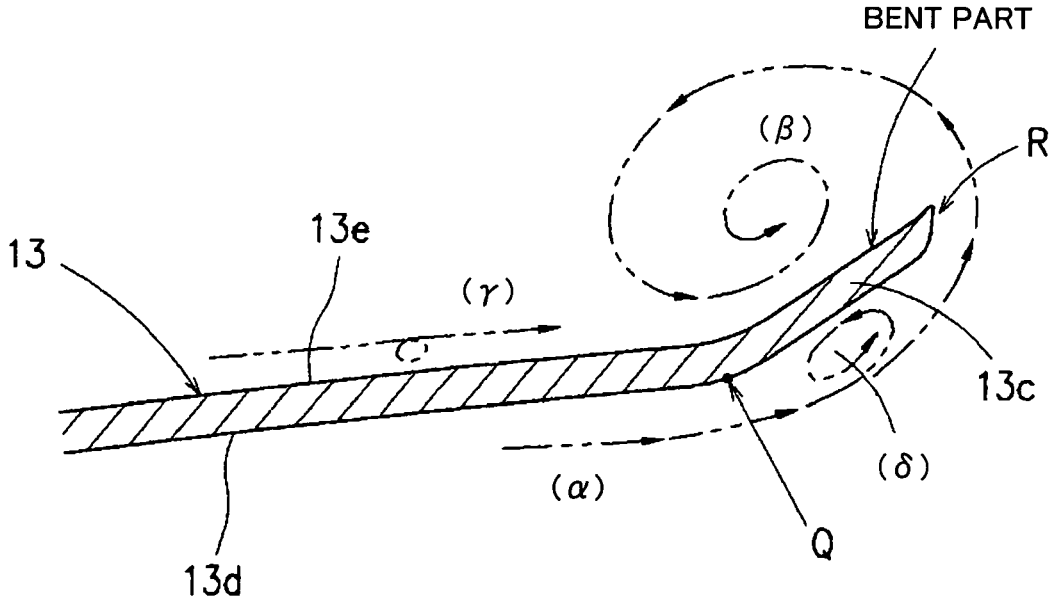
FIG. 9 is an illustrative diagram showing a blade tip vortex/discharge vortex reducing action of the principal part of the air blower apparatus blade.

In accordance with the first embodiment, in the blade (13, 13, 13) of the air blower apparatus (4) which is a so-called swept-forward blade in which, at each of the leading and trailing edges (13*a*) and (13*b*) of the blade (13, 13, 13), the outer peripheral end (R) is situated ahead, relative to the direction of rotation F, of the inner peripheral end (S), the outer peripheral part (13*c*) of the blade (13, 13, 13) is bent toward the suction side into approximately a V-shape so as to form a starting point Q at which an air flow (α) starts leaking. As a result of such arrangement, for example as shown in FIG. 9, an air flow (α) on the side of the pressure surface (13*d*) of the blade (13, 13, 13) flows along the tapering pressure surface (13*d*) on the side of the outer peripheral end (R) and smoothly enters around into the tapering suction surface (13*e*), in almost the same way as the case of the camber part of the aforesaid previous application example. As a result, the vortex diameter of the generated blade tip vortex (β) becomes smaller and stable and an air flow (γ) flowing in the direction of the blade periphery on the side of the suction surface (13*e*) will not interfere with the blade tip vortex (β).

Furthermore, the above action smoothly achieves its effects up to downstream of the trailing edge (13*b*) according to the vortex diameter of the blade tip vortex (β) which is laminated and increased gradually over all the region from the leading edge (13*a*) to the trailing edge (13*b*) and, as a result, is increased in diameter (see for example FIG. 10), because the width W of the bent part of the blade outer peripheral part (13*c*) gradually increases from the vicinity of the leading edge (13*a*) to the vicinity of the trailing edge (13*b*) of the blade (13, 13, 13). Accordingly, for example as shown in FIG. 11, the generated blade tip vortex (β) is unlikely to depart from the blade suction surface (13*e*).

Figure 8:
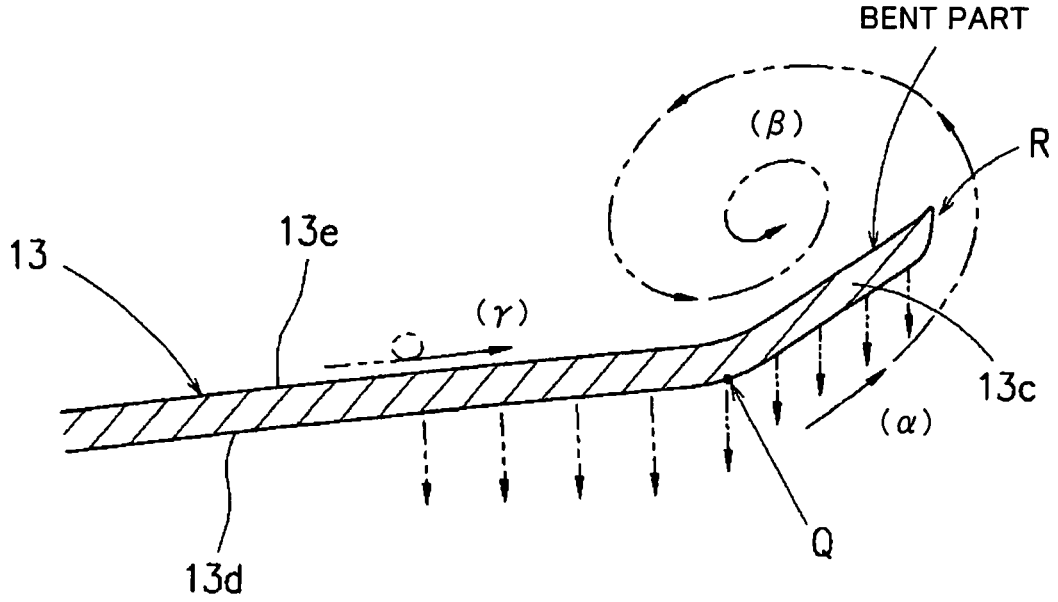
FIG. 8 is an illustrative diagram showing a determination action of a leakage starting point of an air flow of the principal part of the air blower apparatus blade.
Figure 11:
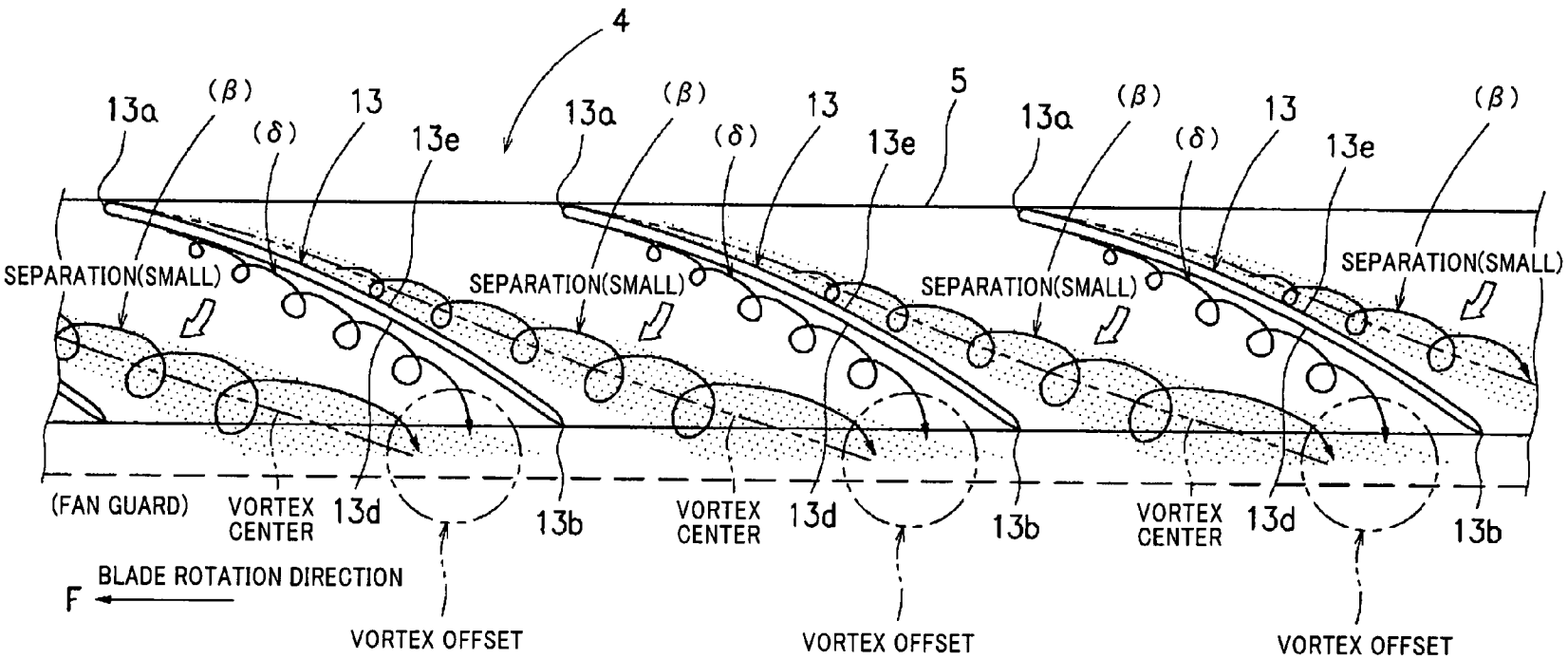
FIG. 11 is an illustrative development view showing a discharge vortex offsetting action of the air blower apparatus blade.

Here, for example in the case where the chord length of the blade (13, 13, 13) is shortened for reducing the weight of the blade (13, 13, 13), the vortex center of a generated blade tip vortex (β) passes, in intact manner, through between adjoining blades (13, 13), as shown in FIG. 11. On the other hand, for the case of the first embodiment, unlike the camber part of the aforesaid previous application, an edge part of the blade outer peripheral part (13*c*) is bent into approximately a V-shape toward the suction side at a given radial-direction position Q as a starting point. This ensures that the starting point Q, at which an air flow (α) flowing from the side of the pressure surface (13*d*) to the suction surface (13*e*) starts leaking, is positively determined, for example as shown in FIG. 8. As a result, the amount of air flow leakage becomes constant and blade tip vortexes (β) generated becomes stable.

Figure 10:
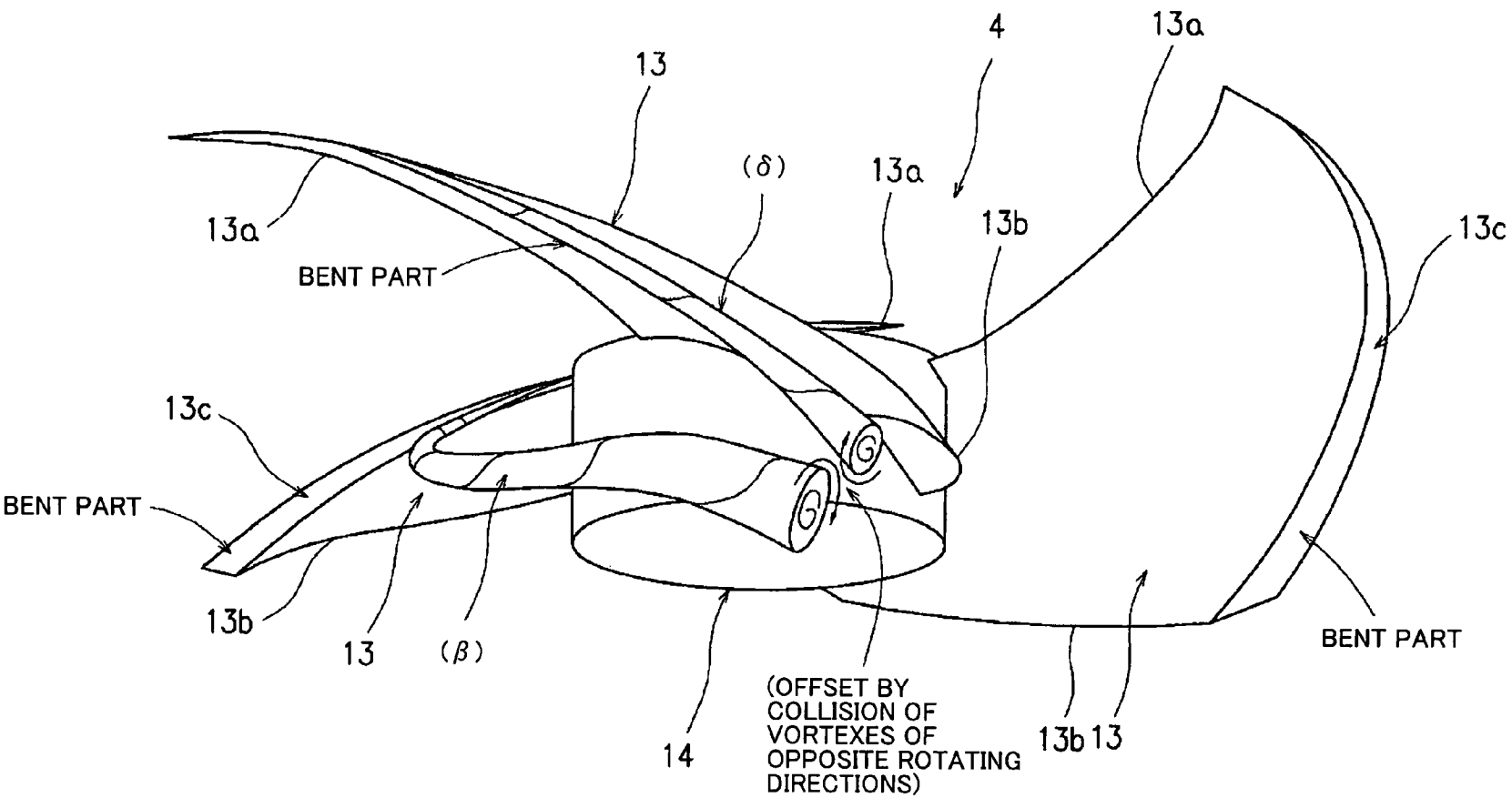
FIG. 10 is an illustrative perspective view showing a discharge vortex offsetting action of the air blower apparatus blade.

In addition to that, separation taking place after the starting point Q generates a longitudinal vortex (δ) on the side of the pressure surface (13*d*) of the blade outer peripheral part (13*c*). For example as shown in FIGS. 10 and 11, a longitudinal vortex (offset vortex) (δ) generated in a certain blade (13), and a blade tip vortex (β) generated in another blade (13) which is situated next to and ahead of the certain blade (13) relative to the rotational direction F of the air blower apparatus (4) depart from the blade surfaces in the vicinity of the trailing edges (13*b*) of the blades (13, 13) respectively. Then, these vortexes (δ) and (β) collide countercurrently and offset each other, and discharge vortexes in the downstream direction, which is the problem with the previous application, are effectively avoided.

Figure 16:
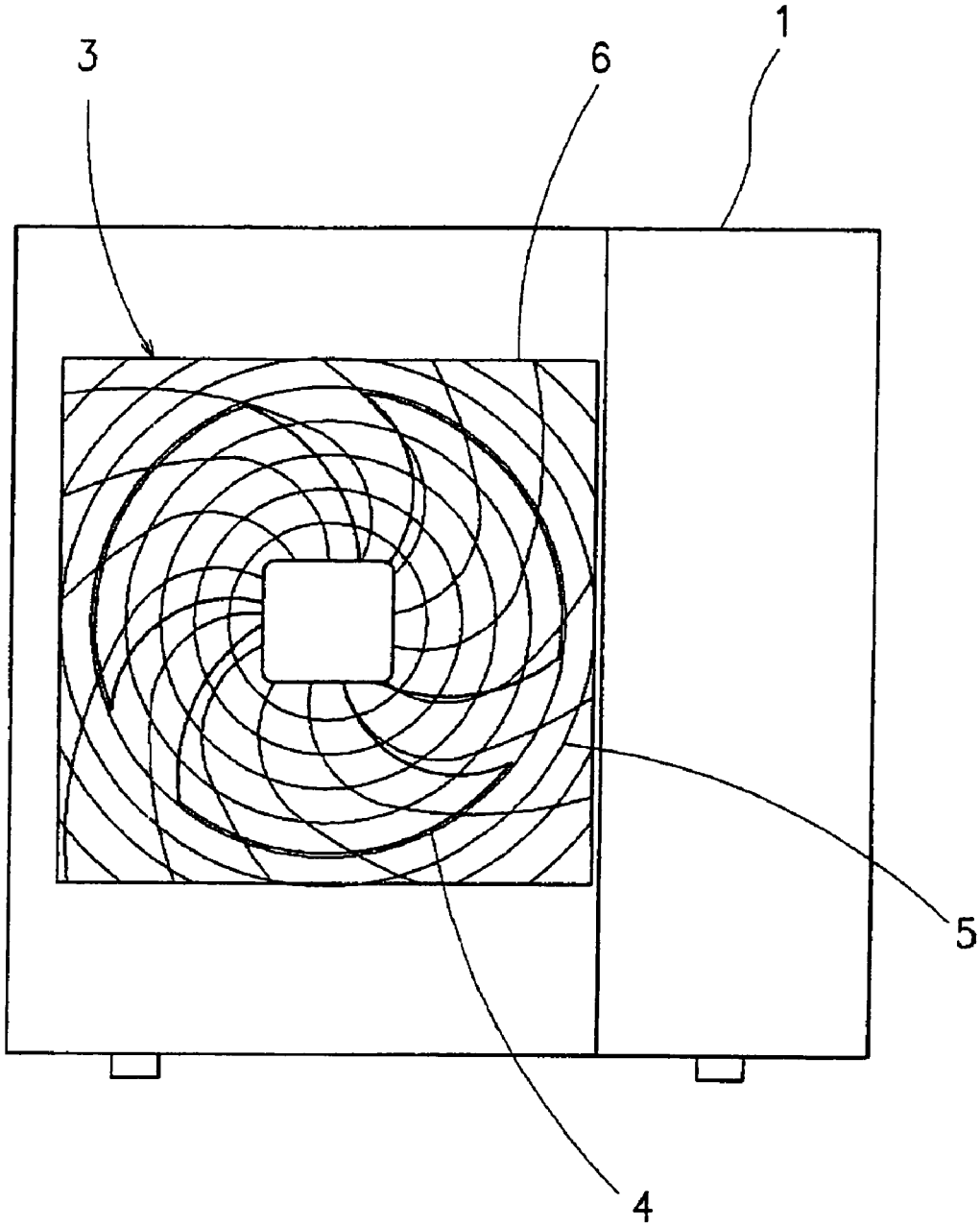
FIG. 16 is a front view showing an arrangement of an air conditioning apparatus outdoor unit employing a conventional air blower apparatus.
Figure 17:
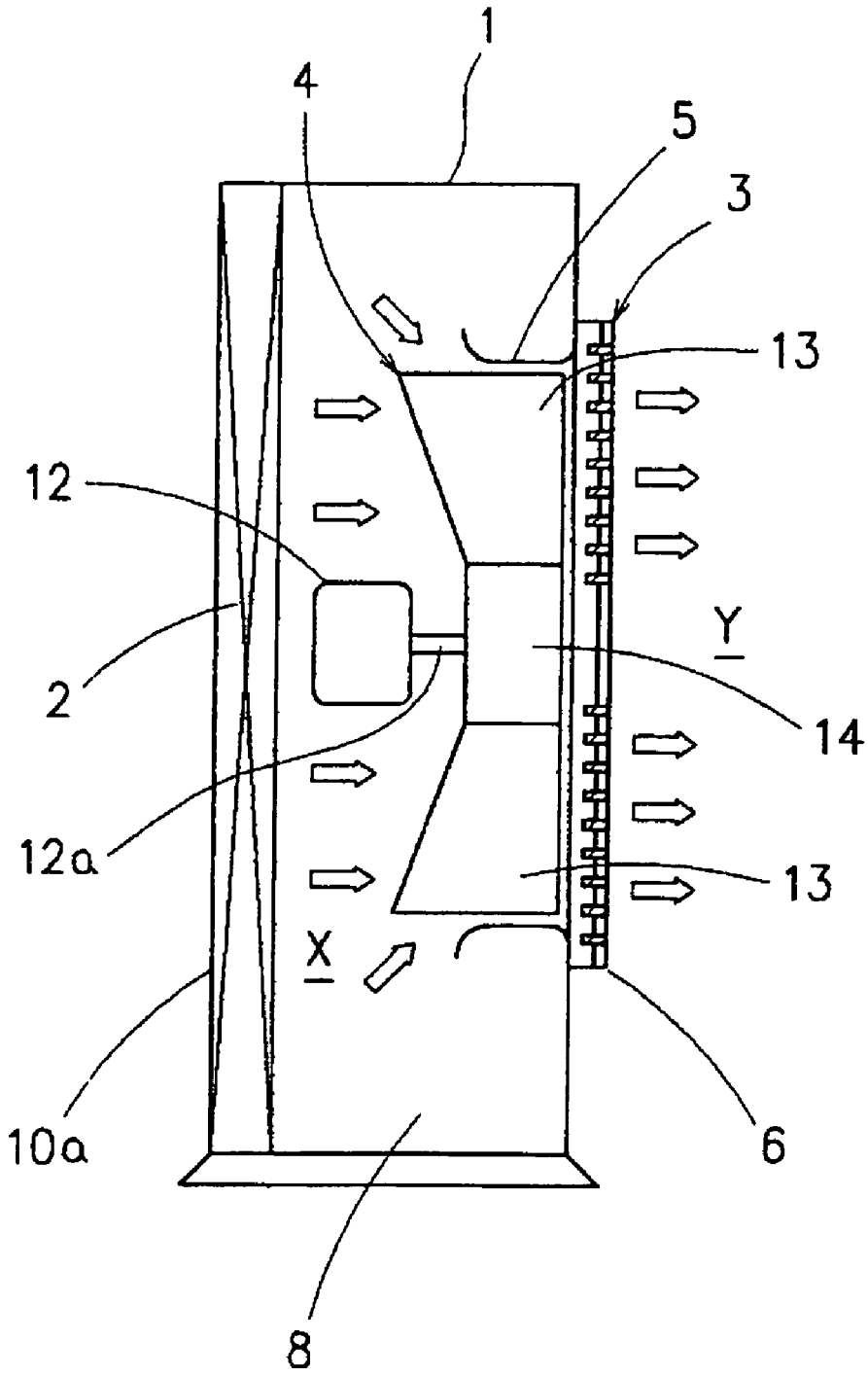
FIG. 17 is a longitudinal cross-sectional view of the conventional outdoor unit.
Figure 18:
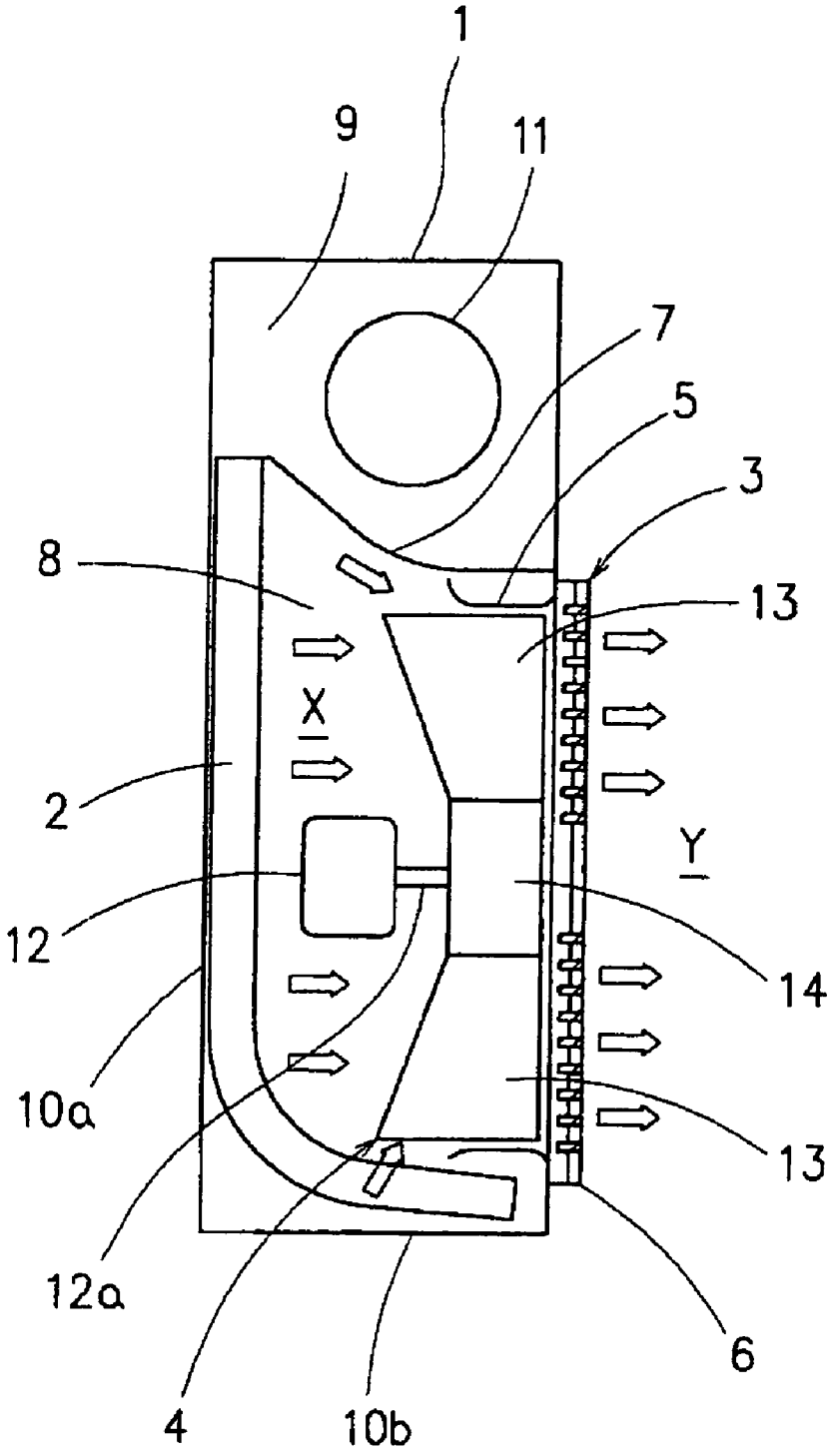
FIG. 18 is a horizontal cross-sectional view of the conventional outdoor unit.
Figure 19:
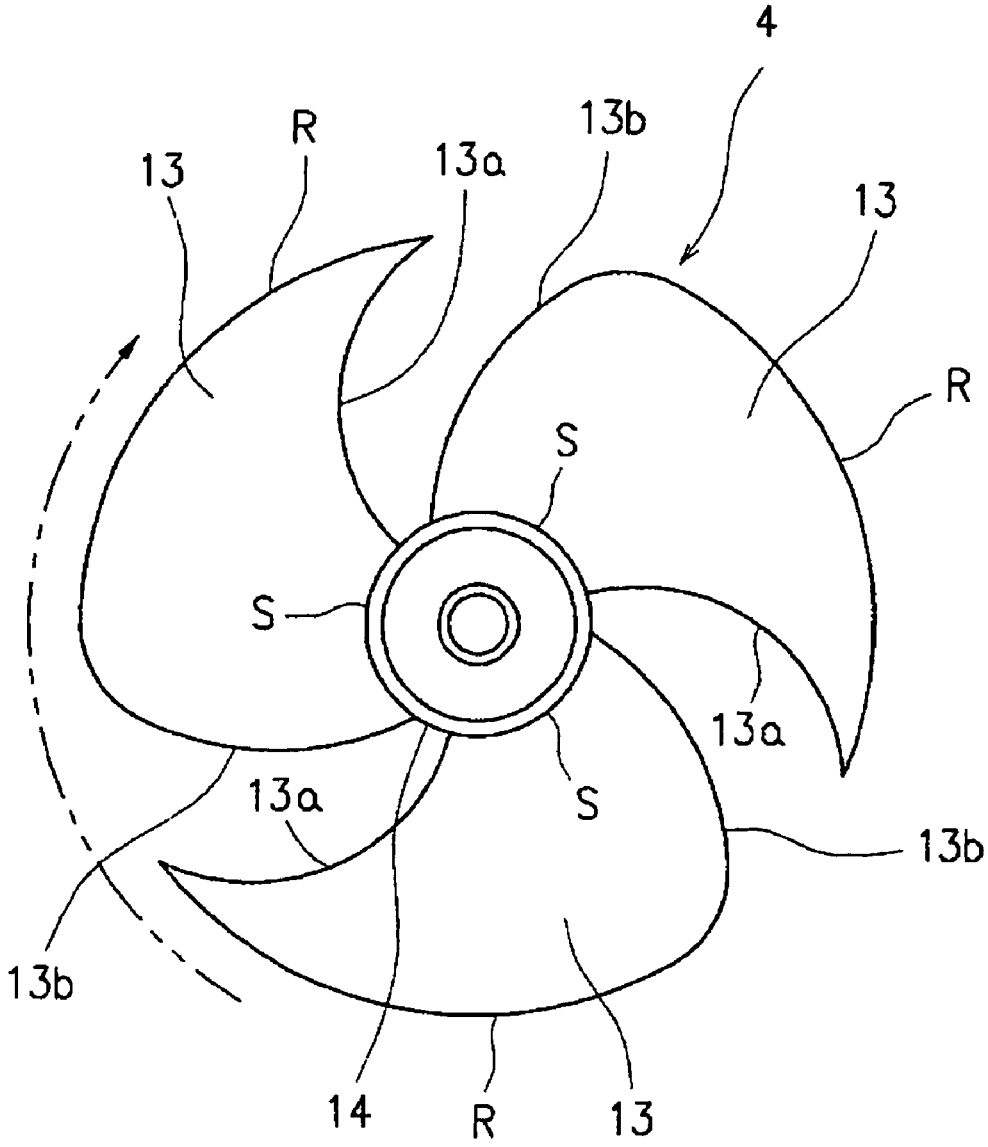
FIG. 19 is a rear view of the conventional air blower apparatus (in the form of a propeller fan) employed in the conventional outdoor unit.
Figure 20:
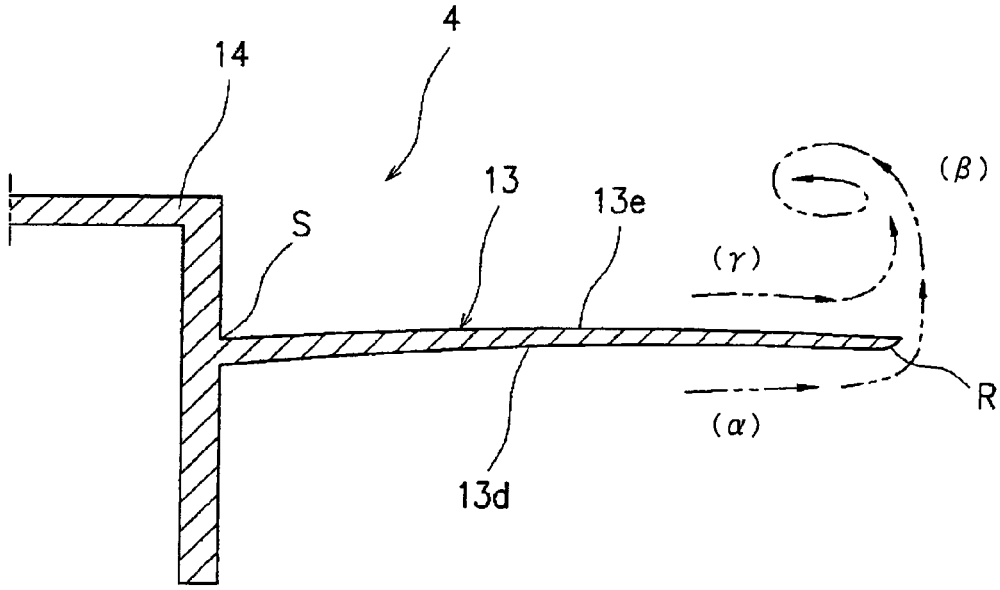
FIG. 20 is a cross-sectional view showing a cross-sectional structure of a blade section of the conventional air blower apparatus and the actions of a principal part thereof.
Figure 21:
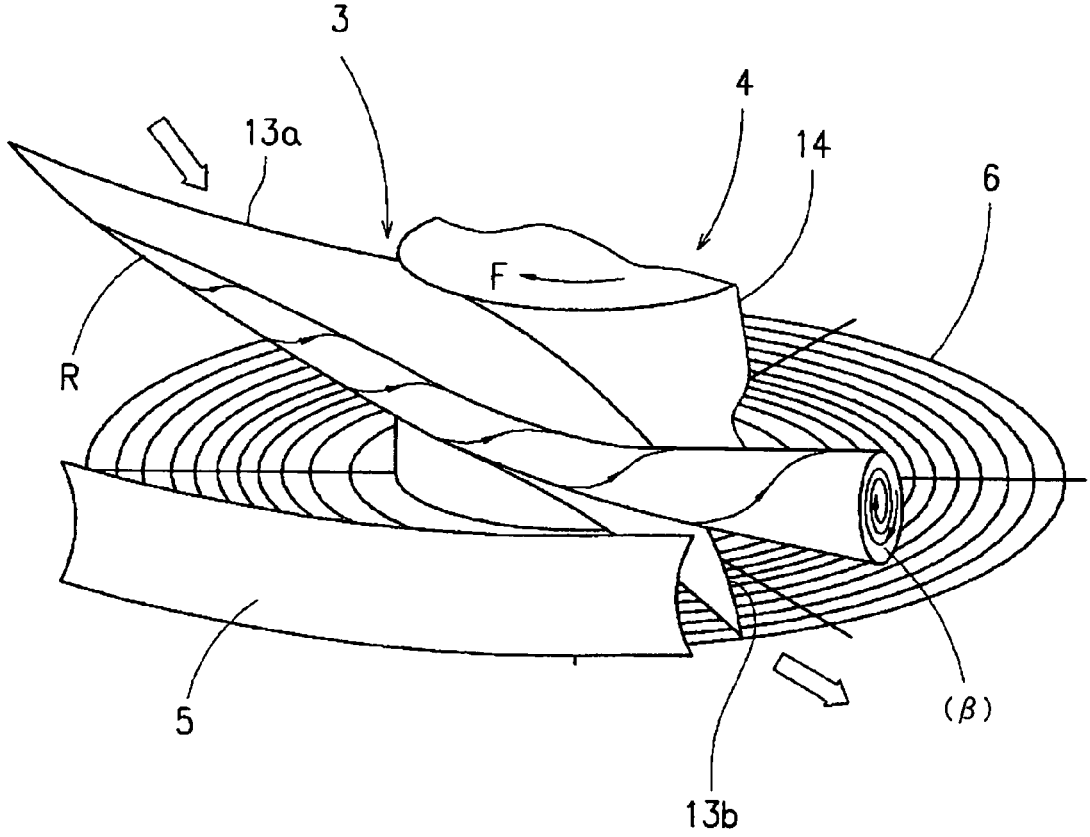
FIG. 21 is a schematic illustrative diagram showing a problem (blade tip vortex generation mechanism) in relation to the structure of an outdoor unit corresponding part of the conventional air blower apparatus.
Figure 22:
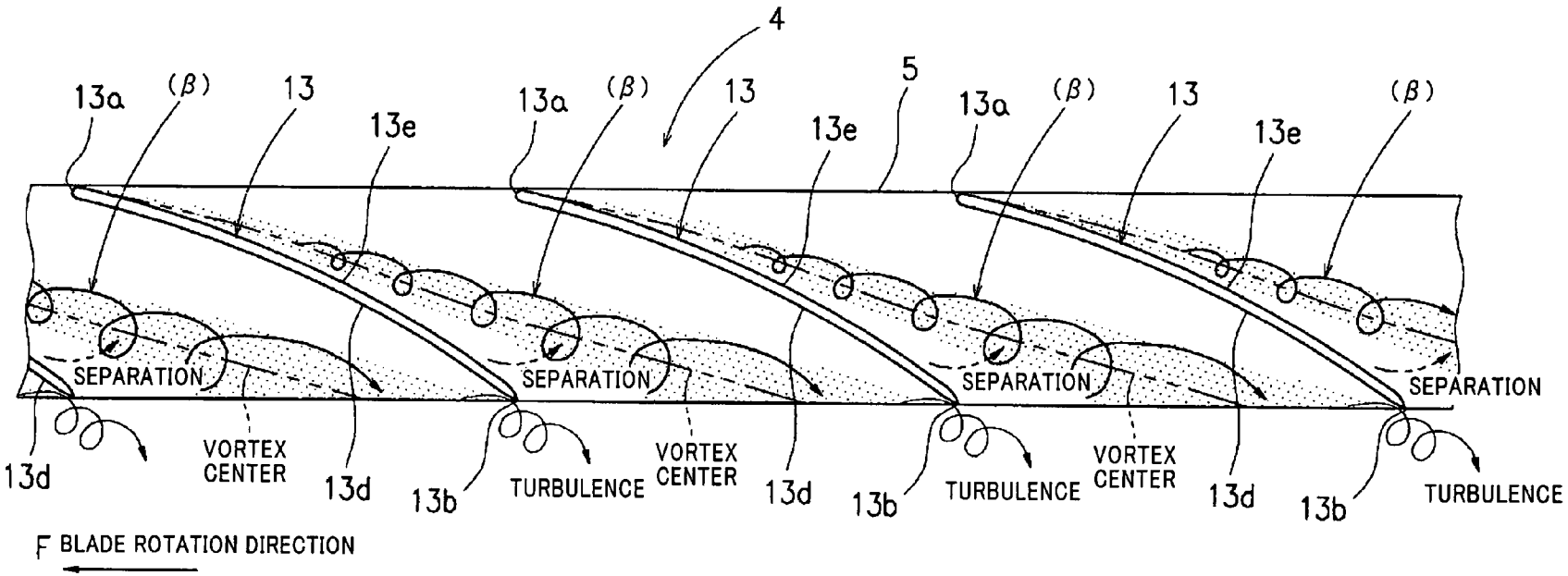
FIG. 22 is a schematic diagram showing a blade tip vortex interference phenomenon between adjoining blades of the conventional air blower apparatus.
Figure 23:
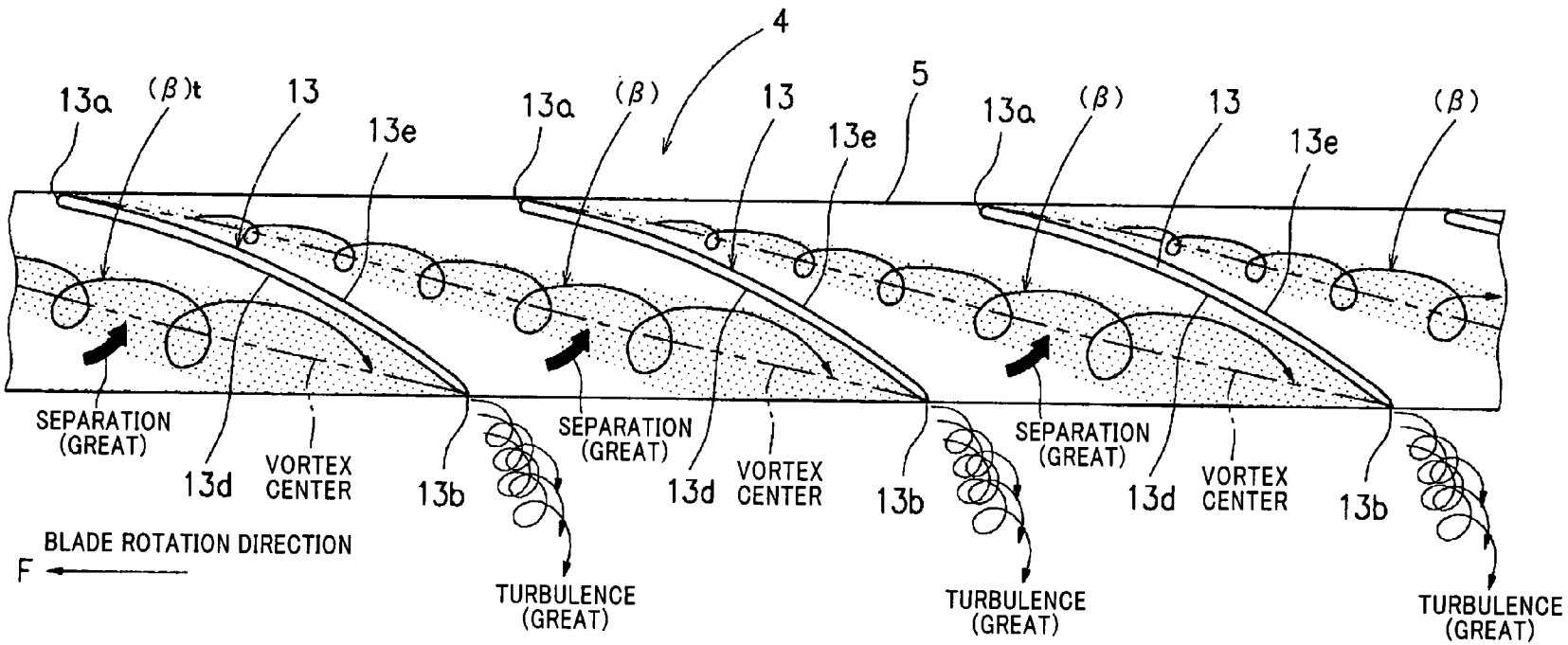
FIG. 23 is a schematic diagram showing a blade tip vortex interference phenomenon between adjoining blades in the case where the chord length of the conventional air blower apparatus blade of FIG. 22 is shortened.
Figure 24:
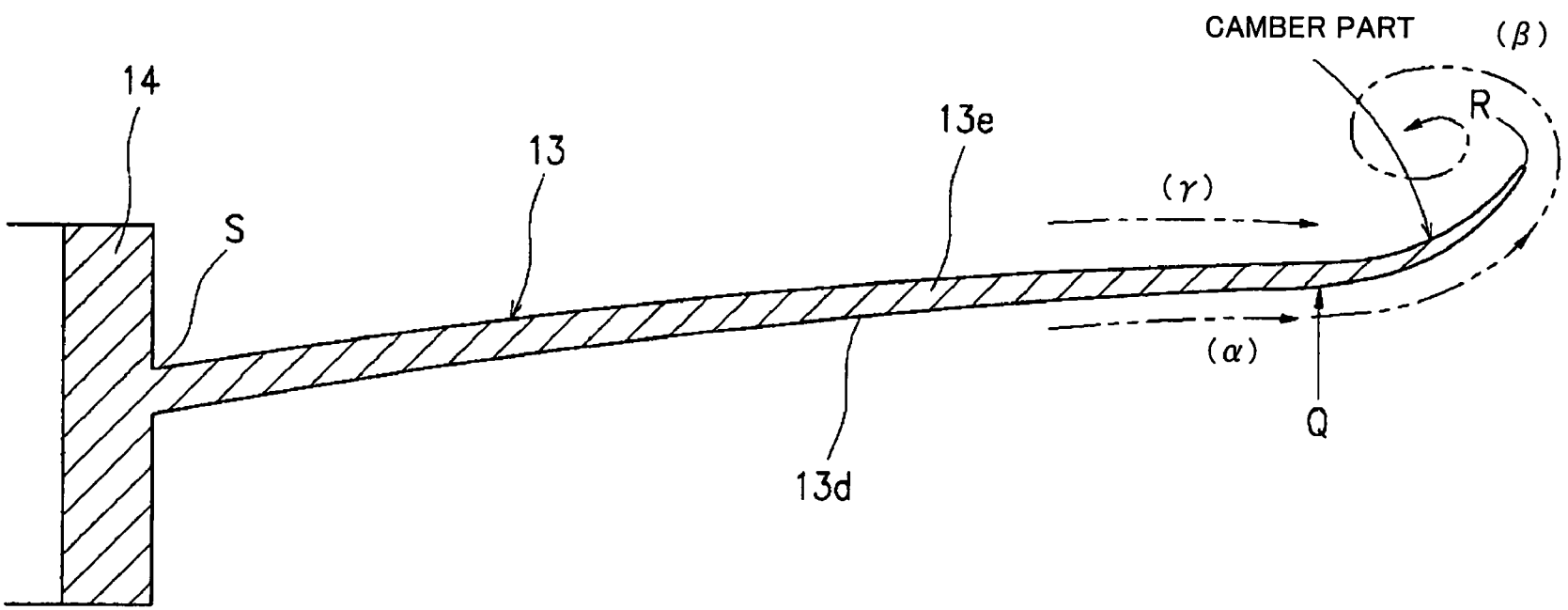
FIG. 24 is a cross-sectional view showing a shape of an impeller blade of the previous application as a partial solution to the problem.

As a result, air flow turbulence on the downstream side of the impeller of the air blower apparatus (4) is reduced, and interference of a fan guard (6) having a grill structure as shown in FIG. 17 with discharge vortexes from the air blower apparatus (4) will not occur. Accordingly, even in the case where the air blower apparatus (4) is incorporated within the aforementioned air conditioning apparatus outdoor unit as shown in FIGS. 16–18, reduction in noise levels will be achieved with effect.

Furthermore, in the air blower apparatus (4), as described above, the radial-direction width W of the bent part is not more than 25% of the length La from the hub-side base end (S) to the outer peripheral end (R) of the blade (13, 13, 13).

It is arranged such that the radial-direction width W of the bent part is, at the maximum width portion in the vicinity of the trailing edge (13*b*), not more than 25% of the length La from the hub-side base end (S) to the outer peripheral end (R) of the blade (13, 13, 13). Such arrangement makes it possible to generate offset vortexes most effectively within the range in which the air supplying performance of the air blower apparatus (4) does not fall off, according to the hub ratio, and further makes it possible to effectively achieve the effect of suppressing blade tip vortexes (β) and discharge vortexes.

Stated another way, although the bent part is effective for the suppressing of blade tip vortexes (β) and discharge vortexes, it does not contribute to the performance of supplying air. Accordingly, there is no point in increasing the width W of the bent part more than necessary. Preferably, at least at the maximum width portion in the vicinity of the trailing edge (13*b*), the width W of the bent part varies within a variation span of not more than 25% of the length La from the hub-side base end (S) to the outer peripheral end (R) of the blade (13, 13, 13) according to the front-to-rear length of the blade outer peripheral end (R) (i.e., $0 \leqq W \leqq 0.25$ La), for making the maintaining of air supplying performance compatible with the suppressing of discharge vortexes et cetera. In other words, preferably the width W of the bent part is, even at the maximum width portion in the vicinity of the trailing edge (13*b*), not more than 25% of the length La from the hub-side bade end (S) to the outer peripheral end (R) of the blade (13, 13, 13), and varies within a variation span of $0 \leqq W \leqq 0.25$ La in the front-to-rear direction of the blade outer peripheral end (R).

Additionally, in the air blower apparatus (4) of the first embodiment, the bending angle θ of the bent part varies gradually from the vicinity of the leading edge (13*a*) to the trailing edge (13*b*) of the outer peripheral end (R) of the blade (13, 13, 13). And, if the bending angle θ of the bent part is varied according to the shape of the blade (13, 13, 13) so that it increases gradually from the vicinity of the leading edge (13*a*) to the trailing edge (13*b*) of the outer peripheral end (R) of the blade (13, 13, 13), this makes it possible to achieve the effect of suppressing blade tip vortexes (β) as effectively as possible.

In other words, in general, the difference in pressure between the pressure surface (13*d*) and the suction surface (13*e*) increases from the leading edge (13*a*) to the trailing edge (13*b*) of the blade (13, 13, 13), in association with which the strength of "entering-around" (variation in air flow direction) of an air flow from the side of the pressure surface (13*d*) into to the side of the suction surface (13*e*) gradually increases toward the trailing edge. On the other hand, if it is constructed such that the bending angle θ at the outer peripheral part (13*c*) of the blade (13, 13, 13) increases gradually from the leading edge (13*a*) to the trailing edge (13*b*) for stable generation of blade tip vortexes (β) on the side of the suction surface (13*e*) in the outer peripheral part (13*c*) of the blade (13, 13, 13), this makes it possible to make the scale of blade tip vortexes (β) which are generated as small as possible.

As described above, by causing the bending angle θ at the blade outer peripheral part (13*c*) to vary gradually from the side of the leading edge (13*a*) to the side of the trailing edge (13*b*), it becomes possible to effectively suppress noise due to the blade tip vortex (β) when incorporated in air conditioning apparatus.

Furthermore, in the air blower apparatus (4) of the first embodiment, the angle $\theta_2$ (see FIG. 7) is not more than 90 degrees.

For example, in the case where the blade (13, 13, 13) whose angle of forward tilting is great is manufactured by synthetic resin molding, the operation of product releasing (i.e., molding removal) becomes difficult to perform, thereby making the efficiency of molding worse. However, if the angle $\theta_2$ is not more than 90 degrees, this makes it possible to provide an adequate draft angle, thereby facilitating molding of the air blower apparatus (4) and improving the efficiency of molding.

Furthermore, in the air blower apparatus (4) of the first embodiment, for example as can be seen from FIG. 5, a cross sectional view of the blade (13, 13, 13) by revolved projection of the curved line K upon a plane which passes through the rotation central axis O of the blade (13, 13, 13) comprises, between the hub (14) and the blade outer peripheral end (R), three regions of different shapes, namely an inner peripheral segment which is concave toward the suction side (or which is approximately in the shape of a straight line), a central segment which is convex toward the suction side, and an outer peripheral segment which is partially bent toward the suction side.

If the cross sectional shape of the blade (13, 13, 13) comprises three regions of different shapes, namely an inner peripheral segment which is concave toward the suction side (or which is in the shape of a straight line), a central segment which is convex toward the suction side, and an outer peripheral end segment which is partially bent toward the suction side, this arrangement allows an air flow in the direction of the blade outer peripheral end (R), generated on the side of the suction surface (13*e*) of the blade (13, 13, 13) by centrifugal force during rotation, to move stably (adhesively) along the suction surface (13*e*) without separation from the suction surface (13*e*) because the inner peripheral segment is concave toward the suction side or is in the shape of a straight line. Accordingly, the air flow is unlikely to interfere with a blade tip vortex (β).

Additionally, because of the arrangement that the shape of the central segment is convex toward the suction side, the flow velocity of an air flow which intends to move to the side of the suction surface (13*e*) from the side of the pressure surface (13*d*) is suppressed beforehand on the side of the pressure surface (13*d*). As a result, it becomes possible to reduce the scale of a blade tip vortex (β) itself which is caused by that air flow.

Furthermore, in the first embodiment, as described above, the outer peripheral part (13*c*) is bent toward the suction side. Because of this, an air flow on the side of the pressure surface (13*d*) of the blade (13, 13, 13) flows along the tapering pressure surface (13*d*) in the blade outer peripheral part (13*c*) and smoothly enters around into the suction surface (13*e*) which is also a tapered surface. As a result, the vortex diameter of the blade tip vortex (β) becomes further reduced and stable, whereby an air flow flowing in the direction of the blade outer peripheral end (R) on the side of the suction surface (13*e*) is unlikely to interfere with a blade tip vortex (β).

Figure 25:
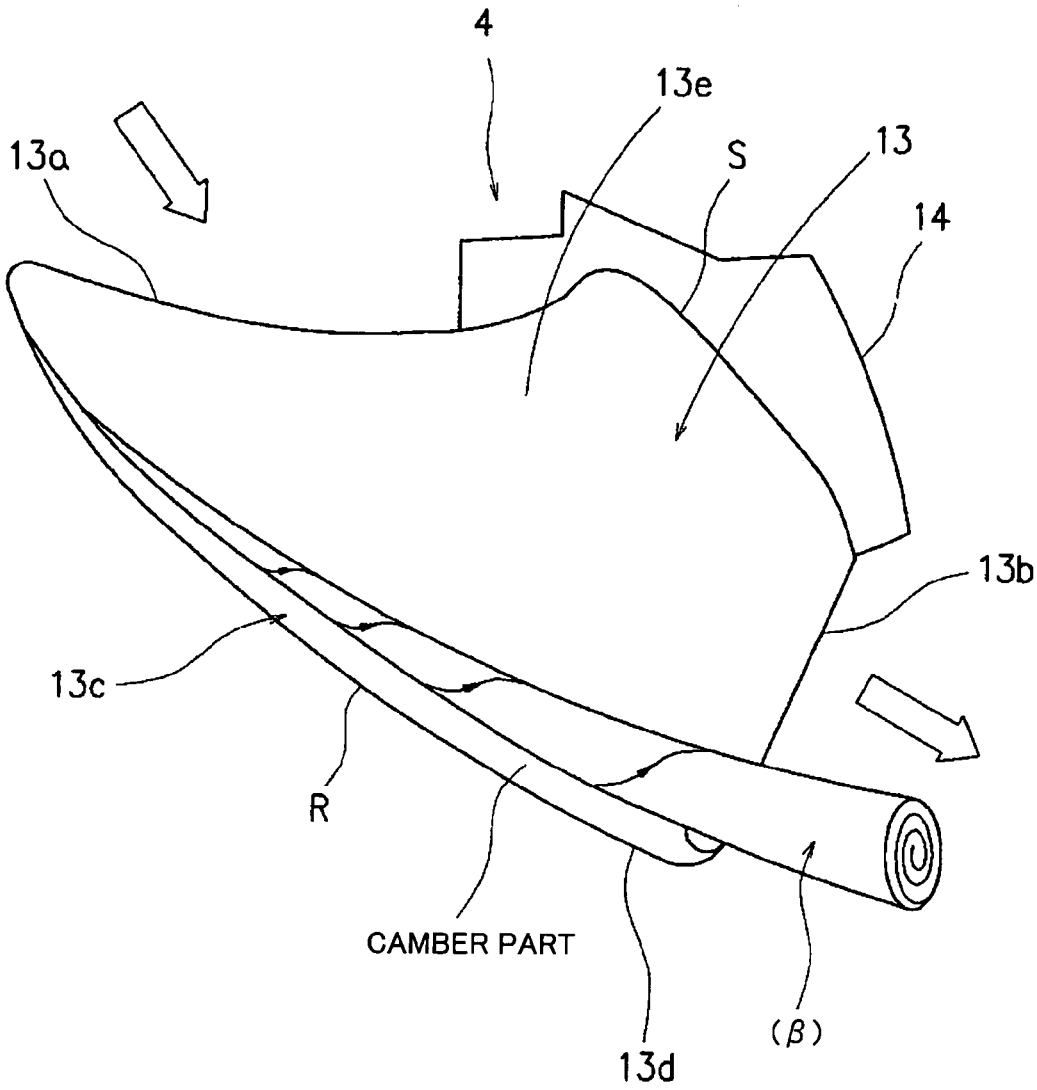
FIG. 25 is a schematic diagram showing a blade tip vortex reducing action of the conventional air blower apparatus impeller section.
Figure 26:
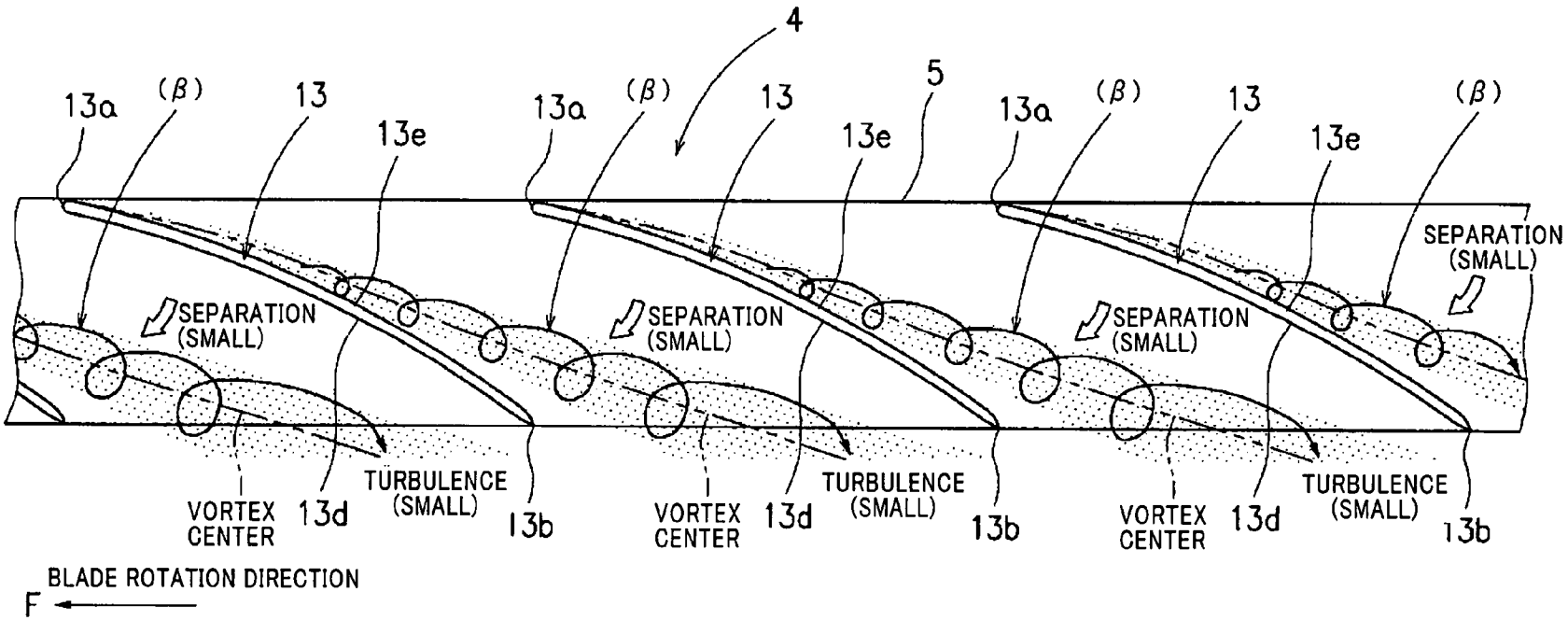
FIG. 26 is an illustrative development diagram of the impeller section, showing a blade tip vortex reducing action of the conventional air blower apparatus.

This action of the blade outer peripheral part (13*c*), when the width W of the bent part of the blade outer peripheral part (13*c*) gradually increases from the vicinity of the leading edge (13*a*) to the vicinity of the trailing edge (13*b*) of the blade (13, 13, 13) as described above, achieves more smoothly its air flow guiding effects from the side of the leading edge (13*a*) up to the side of the trailing edge (13*b*) according to the diameter of the blade tip vortex (β) whose diameter increases when gradually laminated to become larger from the leading edge's (13*a*) side to the trailing edge's (13*b*) side of the blade (13, 13, 13) (see FIG. 25). In addition, the generated blade tip vortex (β) is unlikely to depart from the blade suction surface (13*e*).

Consequently, as described above, even when the length of chord is shortened with a view to reducing the weight of the blade (13, 13, 13), blade tip vortexes (β) generated will not interfere with each other between adjoining blades (13, 13), and discharge air flow turbulence on the downstream side of the air blower apparatus (4) is reduced.

As the result of these, in the first embodiment, the above-described actions are combined together effectively, thereby achieving a satisfactory reduction in levels of noise when incorporated in the air conditioning apparatus outdoor unit.

Even in the case where the inner peripheral segment of the blade (13, 13, 13) is in the shape of a straight line, these operation/working effects are obtained in approximately the same way as the case where the inner peripheral segment is concave.

Furthermore, in the air blower apparatus (4) of the first embodiment, a rounded surface is formed only on the side of the pressure surface (13*d*) of the blade outer peripheral end (R).

Such arrangement that a rounded surface is formed only on the side of the blade pressure surface (13*d*) of the blade outer peripheral end (R) prevents the occurrence of air flow turbulence by the edge part, thereby enabling an air flow to more smoothly enter from the side of the pressure surface (13*d*) of the blade outer peripheral part (13*c*) around into the suction surface (13*e*).

Furthermore, in the air blower apparatus (4) of the first embodiment, for example as shown in FIG. 6, the size of the rounded surface on the side of the blade pressure surface (13*d*) of the blade outer peripheral end (R) (i.e., the curvature radius, r', of the rounded surface) varies in a range from not less than t to not more than 3 t where t is the thickness of the blade (13, 13, 13) in the vicinity of the outer periphery of the impeller of the air blower apparatus (4).

Because of the arrangement that the size of the rounded surface formed on the side of the blade pressure surface (13*d*) of the blade outer peripheral end (R) (i.e., the curvature radius, r', of the rounded surface) is not less than t nor more than 3 t where the thickness of the blade (13, 13, 13) in the vicinity of the outside diameter of an impeller of the air blower apparatus (4) is t, the foregoing air flow guiding actions are more effectively accomplished all over the region from the vicinity of the leading edge (13*a*) to the vicinity of the trailing edge (13*b*).

In other words, if, at the outer peripheral end (R) of the blade (13, 13, 13), the curvature radius r' of the rounded surface formed on the side of the pressure surface (13*d*) is made to range from t to 3 t as described above according to the variation in the direction of an air flow at the time when an air flow enters from the side of the pressure surface (13*d*) around into the side of the suction surface (13*e*), the air flow more smoothly enters from the side of the pressure surface (13*d*) around into the side of the suction surface (13*e*). Consequently, blade tip vortexes (β) are suppressed effectively, thereby achieving a reduction in noise levels.

First Modification Example

Figure 12:
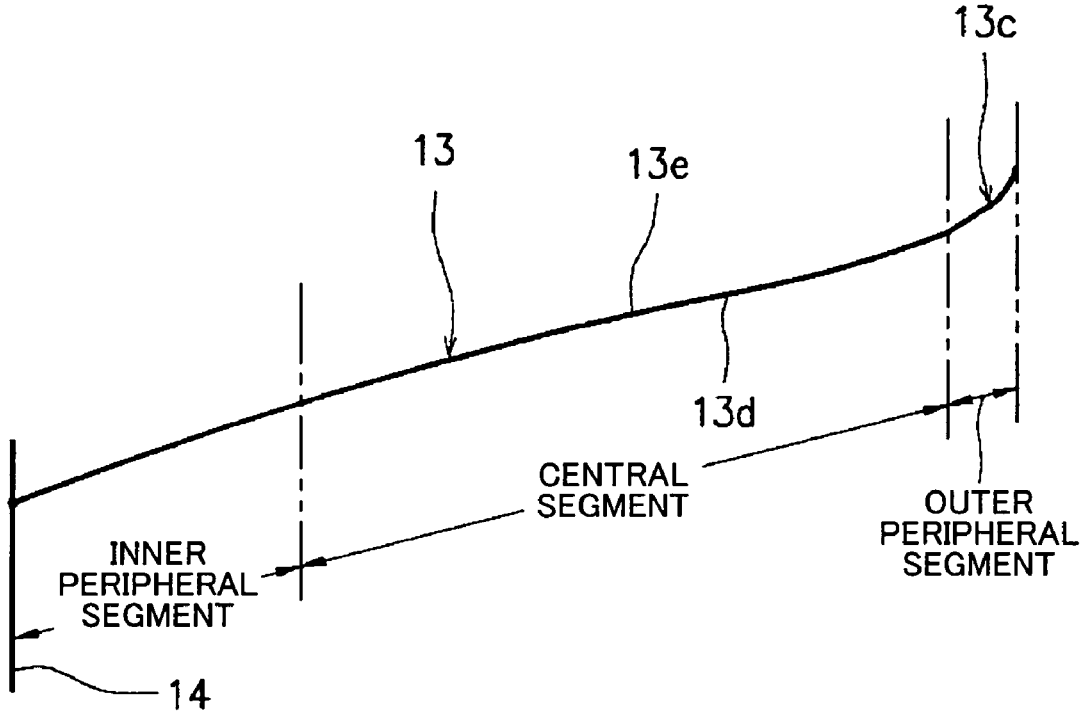
FIG. 12 is a schematic diagram showing an arrangement of a first modification example of the air blower apparatus blade.
Figure 13:
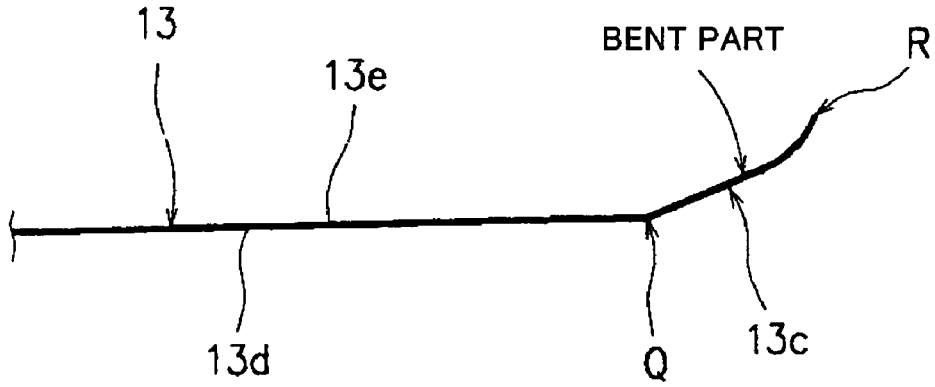
FIG. 13 is an enlarged schematic diagram of the arrangement of the first modification example of the air blower apparatus blade.

The shape of the bent part of the outer peripheral part (13*c*) of the blade (13, 13, 13) is not limited to the above-described linear shape. For example, as shown in FIGS. 12 and 13, the shape of the bent part may be a curved surface formed by curling partially the vicinity of a leading end of the bent part which is approximately linearly formed, i.e., only the vicinity of the outer peripheral end (R), toward the suction side. This enables an air flow to readily enter from the side of the pressure surface (13*d*) around into the suction surface (13*e*), thereby reducing the diameter of the blade tip vortex (β) to a further extent.

Second Modification Example

Figure 14:
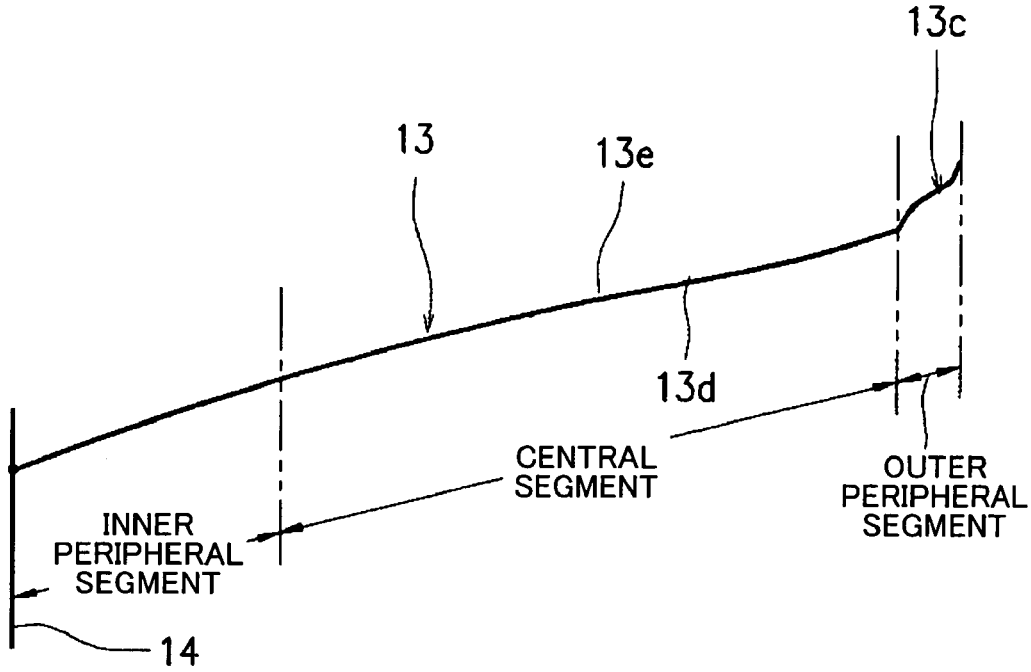
FIG. 14 is a schematic diagram showing an arrangement of a second modification example of the air blower apparatus blade.
Figure 15:
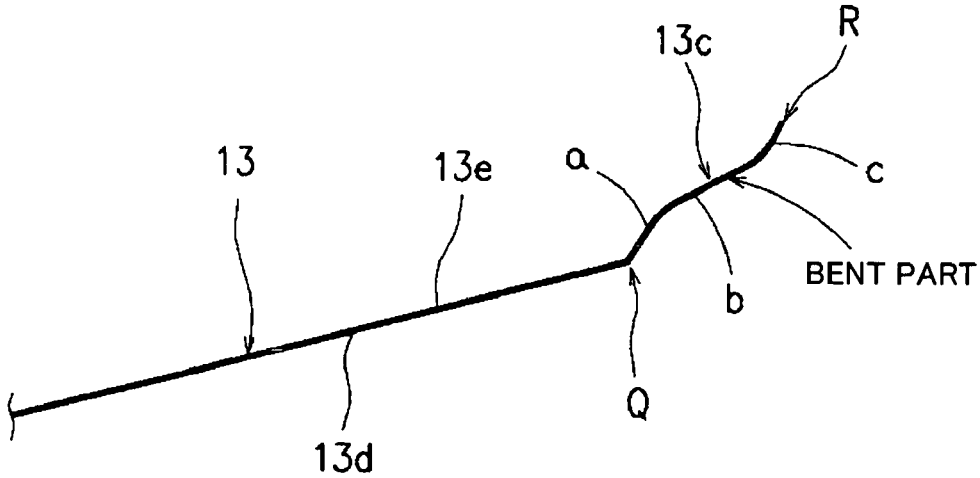
FIG. 15 is an enlarged schematic diagram of the arrangement of the second modification example of the air blower apparatus blade.

For example, as shown in FIGS. 14 and 15, the bent part of the blade outer peripheral part (13*c*) may be approximately S-shaped. More specifically, in this second modification example, the entire shape of the bent part is formed into approximately an S-shape in the following way. A portion positioned ahead of a part (a) bent linearly toward the suction side is rebent toward the side of the pressure surface (13*d*) to form a blade extension surface (b) and its outer peripheral end (c) is bent toward the suction side, so that the bent part is S-shaped. Also for the case of such a configuration, the blade tip vortex (β) is reduced with effect and, in addition, it is possible to eliminate discharge vortexes from between adjoining blades.

Effects of First Embodiment

Accordingly, the air blower apparatus (4) of the first embodiment provides the following beneficial effects.

(i) Noise generated by the air blower apparatus (4) itself is reduced, and, in addition, noise when the air blower apparatus (4) is incorporated within an air conditioning apparatus outdoor unit is reduced effectively.

(ii) Even in the case where the chord length of the blade (13, 13, 13) is shortened for accomplishing reduction in weight and costs of the blade (13, 13, 13), the blade tip vortex (β) will not leave the suction surface and will not interfere with the adjoining blade, and the discharging of vortexes from between adjoining blades is reduced effectively. As a result, interference of the blade tip vortex (β) with external obstacles such as a fan guard, grill et cetera is reduced, thereby both providing enhanced noise reduction effects and suppressing the drop in air supplying performance.

(iii) Molding becomes easy to perform and reduction in manufacturing costs is achieved, which is achieved just by forming a bent part at an outer peripheral end portion which is a part of the blade (13, 13, 13), without affecting the entire shape of the blade (13, 13, 13) which determines the air supplying performance thereof.

(iv) Additionally, since the bent part achieves a rib action, this increases the rigidity of the blade (13, 13, 13). As a result, the blade (13, 13, 13) can be thinned, thereby making it possible to further reduce the manufacturing costs of the blade (13, 13, 13). At the same time, the vibration resistance of the blade (13, 13, 13) is improved, thereby reducing the generation of abnormal noise due to vibrations.

(v) In addition to the above-mentioned effects, the drop in air supplying performance is suppressed or prevented.

Other Embodiments

Bending Angle θ of Bent Part

Figure 2:
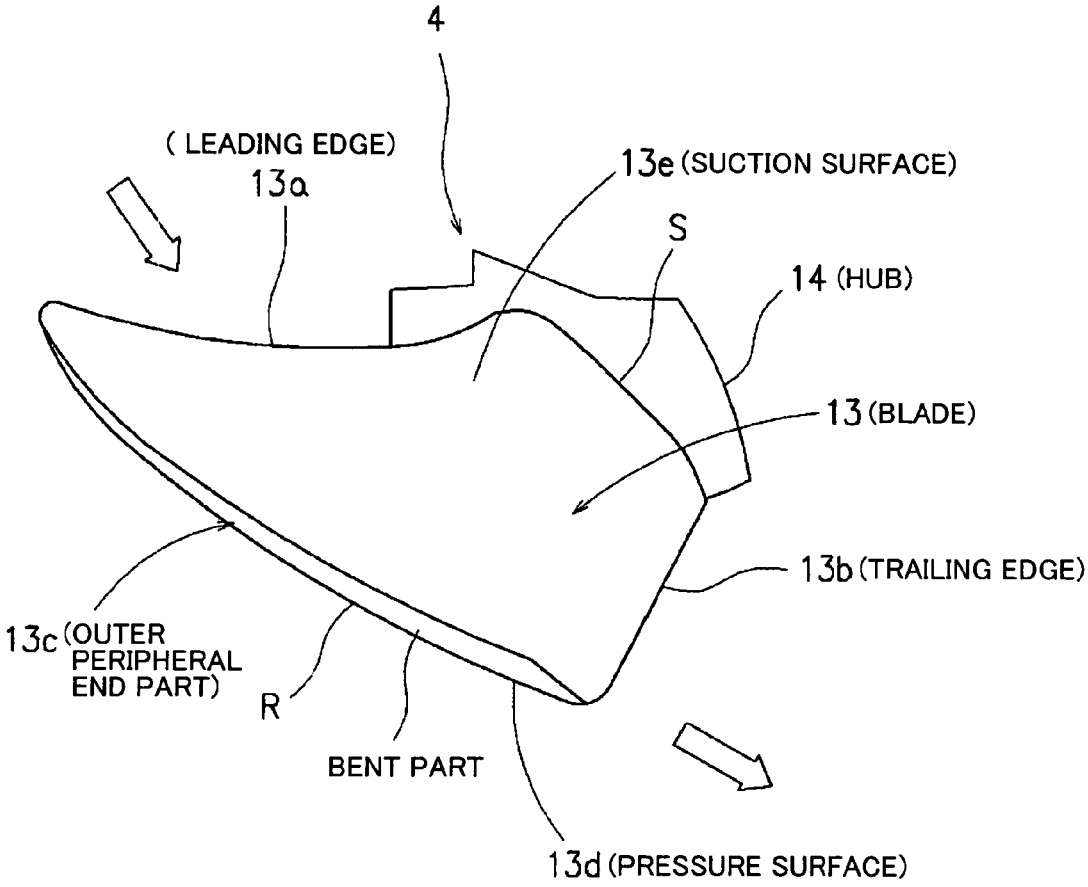
FIG. 2 is a partially broken perspective view of a blade section of the air blower apparatus.
Figures 4A, 4B, 4C:
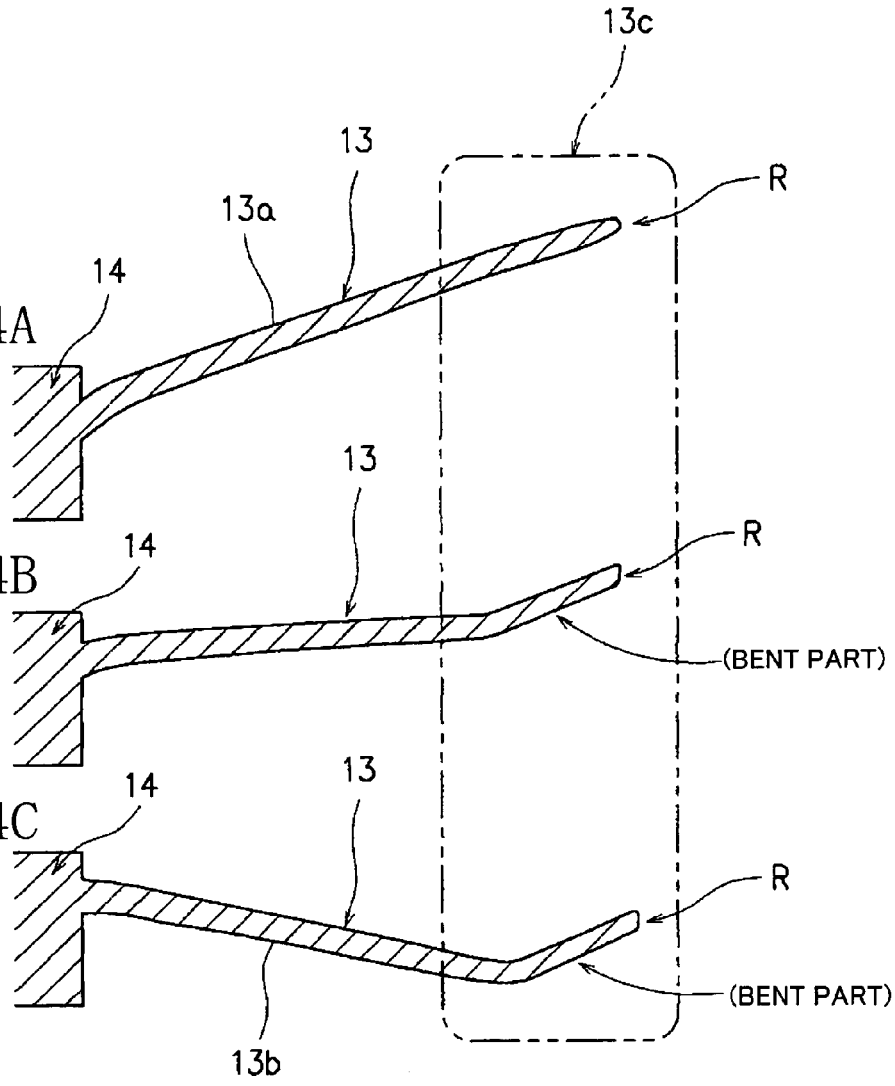
FIG. 4 shows, in cross section relative to the radial direction, three different structures of the air blower apparatus blade.

In the bent part of the first embodiment, for example as shown in FIGS. 2–4, the radial-direction width W of the bent part increases gradually from the leading edge (13*a*) to the trailing edge (13*b*) of the blade (13, 13, 13) and, on the other hand, the bending angle θ of the bent part (see FIG. 7) stays unchanged.

Contrary to the above, it may be arranged such that the bending angle θ of the bent part gradually increases or becomes steep from the leading edge (13*a*) to the trailing edge (13*b*) of the blade (13, 13, 13). Also in such a case, completely the same operation/working effects that the first embodiment provides are obtained.

Stated another way, in general, the difference in pressure between the pressure surface (13*d*) and the suction surface (13*e*) increases from the leading edge (13*a*) to the trailing edge (13*b*) of the blade (13, 13, 13), in association with which the strength of "entering-around" (variation in air flow direction) of an air flow from the side of the pressure surface (13*d*) into the side of the suction surface (13*e*) gradually increases toward the trailing edge. On the contrary, if it is constructed such that the bending angle θ at the outer peripheral part (13*c*) of the blade (13, 13, 13) increases gradually from the leading edge (13*a*) to the trailing edge (13*b*) (the angle of inclination of the bent part becomes steep) for stable generation of blade tip vortexes (β) on the side of the suction surface (13*e*) formed in the outer peripheral part (13*c*) of the blade (13, 13, 13), this makes it possible to make the scale of blade tip vortexes (β) which are generated as small as possible.

Furthermore, in the case where the bending angle θ is varied as describe above, on the contrary to the above, the bending angle θ may be decreased gradually from the leading edge (13*a*) to the trailing edge (13*b*) (the angle of inclination of the bent part becomes gentle).

As previously stated, the difference in pressure between the pressure surface's (13*d*) side and the suction surface's (13*e*) side at the outer peripheral part (13*c*) of the blade (13, 13, 13) increases from the leading edge's (13*a*) side toward the trailing edge's (13*b*) side, in association with which the blade tip vortex (β) grows and its vortex diameter likewise increases.

To cope with the above, the bending angle θ of the bent part is also made gradually gentle, so that the bending angle θ will decrease according to the growth of the blade tip vortex (β) which grows gradually toward the side of the trailing edge (13*b*). This construction accordingly ensures that the blade tip vortex (β) is held on the side of the suction surface (13*e*) of the bent part formed at the outer peripheral part (13*c*) of the blade (13, 13, 13), thereby suppressing interference with an adjacent blade (13). Additionally, it becomes possible to cause the blade tip vortex (β) which grows gradually to effectively enter from the side of the pressure surface (13*d*) around into the side of the suction surface (13*e*) of the blade (13, 13, 13).

Type of Blade

In each of the foregoing embodiments, the description has been made in terms of blades having a thin blade structure. However, there is no need to say that the present invention is applicable to commonly-used thick blades, to various thick blades superior in air supplying performance, to other types of blades in completely the same way as applied to blades having a thin blade structure.

Industrial Applicability

As has been described above, the present invention finds application as an air blower apparatus for use in air conditioning apparatus outdoor units.

What is claimed is:

1. An air blower apparatus comprising a hub which becomes a center of rotation and a plurality of blades disposed along an outer peripheral surface of said hub, wherein outer peripheral ends of leading and trailing edges of each said blade are situated ahead of the inner peripheral ends, relative to the direction of rotation, wherein an outer peripheral part of each said blade is bent toward the suction side so as to define a starting point at which an air flow starts leaking, and wherein the radial-direction width, W, of said bent part gradually increases from the vicinity of said leading edge to the vicinity of said trailing edge.

2. The air blower apparatus of claim 1, wherein the radial-direction width, W, of said bent part is not more than 25% of a length La from a hub-side base end to a radial-direction outer peripheral end (R) of each said blade.

3. The air blower apparatus of claim 1, wherein, in a chord line C in a given blade radial r, the length of said chord line C is Lo, a given point on said chord line C is P, and the length from said blade leading edge to said given point P is L while on the other hand a radial-direction curved line, which extends from a hub-side base end (S) to an outer peripheral end (R) of each said blade and passes through said given point P so that the ratio of said length L and said length Lo (i.e., L/Lo) is constant, is K, and wherein the angle, which is formed by the intersection of (a) a straight line Q-R connecting a point Q at which said outer peripheral part of each said blade starts bending toward the suction side and said outer peripheral end (R) of each said blade in a curved line K' which is a revolved projection of said curved line K onto a plane including a rotation central axis O and (b) a tangent line A–A' at said point Q of said curved line K' closer to the side of an inner periphery of each said blade than said point Q, is a bending angle θ, wherein:

said bending angle θ is varied gradually from the vicinity of said leading edge to the vicinity of said trailing edge of said outer peripheral end (R) of said blade.

4. The air blower apparatus of claim 3, wherein said curved line K' comprises, between said hub-side base end (S) and said outer peripheral end (R), an inner peripheral segment which is in the form of a straight line, a central segment which is convex toward the suction side, and an outer peripheral segment which is bent toward the suction side, and is hook-shaped as a whole.

5. The air blower apparatus of claim 3, wherein said curved line K' comprises, between said hub-side base end (S) and said outer peripheral end (R), an inner peripheral segment which is concave toward the suction side, a central segment which is convex toward the suction side, and an outer peripheral segment which bent toward the suction side, and is hook-shaped as a whole.

6. The air blower apparatus of any one of claims 3–5, wherein the angle $\theta_2$, formed by the said bent part of said blade outer peripheral part on said curved line K' and a plane orthogonal to said rotation central axis O, is not more than 90 degrees.

7. The air blower apparatus of claim 1, wherein a rounded surface is formed only on the side of said blade pressure surface of said blade outer peripheral end (R).

8. The air blower apparatus of claim 7, wherein the size of said rounded surface formed on the side of said blade pressure surface of said blade outer peripheral end (R) is not less than t nor more than 3t where t is the thickness of said blade in the vicinity of the outside diameter of an impeller.

9. The air blower apparatus of claim 1, wherein said air blower apparatus is so constructed as to be incorporated within an air conditioning apparatus outdoor unit.

10. A fan blade, comprising:

a surface, having a suction side, bounded by a leading edge and a trailing edge; and an outer peripheral end, transversely disposed between the leading edge and the trailing edge, which is situated, ahead of the inner peripheral ends, relative to the direction of rotation wherein an outer peripheral part of the blade is bent toward the suction side.

11. The fan blade of claim 10, wherein a radial-direction width of the bent outer peripheral end gradually increases from the leading edge to the trailing edge.

12. The fan blade of claim 10, wherein the radial-direction width of the bent outer peripheral end is 25% less of a length from a hub-side end to a radial-direction outer peripheral end.

* * * * *